US012440721B2

(12) United States Patent
Hammer

(10) Patent No.: US 12,440,721 B2
(45) Date of Patent: Oct. 14, 2025

(54) TRAINING APPARATUS WITH PROGRESS INDICATOR AND UNIFIED BASE FOR DIFFERENT APPARATUS TYPES

(71) Applicant: VISION 8 GmbH, Gräfelfing (DE)

(72) Inventor: Markus Hammer, Gräfelfing (DE)

(73) Assignee: VISION 8 GMBH, Gräfelfing (DE)

( * ) Notice: Subject to any disclaimer, the term of this patent is extended or adjusted under 35 U.S.C. 154(b) by 201 days.

(21) Appl. No.: 18/546,771

(22) PCT Filed: Feb. 17, 2022

(86) PCT No.: PCT/IB2022/051410

§ 371 (c)(1),
(2) Date: Aug. 16, 2023

(87) PCT Pub. No.: WO2022/175857

PCT Pub. Date: Aug. 25, 2022

(65) Prior Publication Data

US 2024/0131391 A1 Apr. 25, 2024
US 2024/0226651 A9 Jul. 11, 2024

(30) Foreign Application Priority Data

Feb. 17, 2021 (EP) ..... 21157617

(51) Int. Cl.
*A63B 22/08* (2006.01)
*A63B 21/005* (2006.01)
(Continued)

(52) U.S. Cl.
CPC ..... *A63B 22/0046* (2013.01); *A63B 21/0058* (2013.01); *A63B 22/025* (2015.10);
(Continued)

(58) Field of Classification Search
CPC ..... A63B 22/0015; A63B 22/0017; A63B 22/0046; A63B 22/025; A63B 22/06;
(Continued)

(56) References Cited

U.S. PATENT DOCUMENTS 4,976,426 A * 12/1990 Szabo ..... A63B 22/0002 601/36
6,902,513 B1 * 6/2005 McClure ..... A63B 24/0006 482/4
(Continued)

FOREIGN PATENT DOCUMENTS

CN 210644982 U 6/2020
CN 113398525 A * 9/2021 ..... A63B 21/023
(Continued)

OTHER PUBLICATIONS

Written Opinion for related international application No. PCT/IB2022/051410, mailed May 11, 2022.

*Primary Examiner* — Joshua T Kennedy

(57) ABSTRACT

A training apparatus having a progress indicator and unified base for different apparatus types, such as for an ergometer, speed bike, recumbent bike, home training bike, rowing apparatus, elliptical trainer, cross-trainer or treadmill. The fitness apparatus of every apparatus type is based on a structure which is unified in terms of technical design, according to which the frame or pedestal of the fitness apparatus has rollers which are arranged on the frame or pedestal such that a tilt-stable positioning of the frame with respect to the subsurface and a longitudinal displacement of the frame or of the frame together with the pedestal relative to the subsurface is enabled by means of an actuator depending on the measure of success of the user training.

21 Claims, 10 Drawing Sheets

(51) Int. Cl.

| | |
|---|---|
| ***A63B 22/00*** | (2006.01) |
| ***A63B 22/02*** | (2006.01) |
| ***A63B 22/06*** | (2006.01) |
| ***A63B 24/00*** | (2006.01) |
| ***A63B 71/06*** | (2006.01) |

(52) U.S. Cl.
CPC ..... *A63B 22/06* (2013.01); *A63B 24/0062* (2013.01); *A63B 71/0622* (2013.01); *A63B 2024/0068* (2013.01); *A63B 2024/0093* (2013.01)

(58) Field of Classification Search
CPC ..... A63B 21/0058; A63B 71/0622; A63B 2024/0068; A63B 2024/0093; A63B 2022/002
See application file for complete search history.

(56) References Cited

U.S. PATENT DOCUMENTS

| | | | | |
|---|---|---|---|---|
| 7,747,671 | B2 * | 6/2010 | Ku | A63B 24/00 709/200 |
| 8,409,057 | B2 * | 4/2013 | Martens | A63F 13/80 482/8 |
| 9,248,071 | B1 * | 2/2016 | Benda | A63B 71/0009 |
| 10,434,394 | B2 | 10/2019 | Bass et al. | |
| 10,561,877 | B2 * | 2/2020 | Workman | A63B 22/0046 |
| 11,975,235 | B2 * | 5/2024 | Pacheco Hernandez | A63F 13/245 |
| 2007/0060453 | A1 * | 3/2007 | Papadopoulos | A63B 69/16 482/61 |
| 2010/0197460 | A1 * | 8/2010 | Czarnecki | A63F 13/816 482/2 |
| 2011/0275500 | A1 | 11/2011 | Hur | |
| 2019/0070476 | A1 * | 3/2019 | Bass | A63B 21/005 |
| 2019/0118058 | A1 | 4/2019 | Bass et al. | |
| 2022/0323823 | A1 * | 10/2022 | Lee | A63B 24/0087 |
| 2024/0416182 | A1 * | 12/2024 | Andreescu | A63B 22/0235 |

FOREIGN PATENT DOCUMENTS

| | | | |
|---|---|---|---|
| EP | 3327597 | A1 | 5/2018 |
| KR | 20190029151 | A | 3/2019 |
| KR | 1020190029151 | A | 3/2019 |

* cited by examiner 48,49,48',49'

TRAINING APPARATUS WITH PROGRESS INDICATOR AND UNIFIED BASE FOR DIFFERENT APPARATUS TYPES

BACKGROUND

The invention relates to a training apparatus, also referred to as a fitness apparatus, such as an ergometer, a speed bike, a recumbent bike or recumbent ergometer, respectively, home training bike or ergometer without watt functionality, respectively, a rowing apparatus, an elliptical trainer, a cross trainer or even a treadmill. Such training or fitness apparatuses, respectively, of different apparatus types are in particular intended for use at home as home trainer or in a fitness studio.

Increasing interest in physical activity in order to stay healthy and increasing urbanization of societies lead to more and more people training indoors using fitness apparatuses, either in fitness studios or at home. Parallel thereto, the range and variety of training apparatuses that can be used in the fitness studio or at home have increased. This includes apparatuses of different apparatus types, such as ergometers, speed bikes, recumbent bike or recumbent ergometers, home training bikes, rowing apparatuses, elliptical trainers, cross trainers, or treadmills. In spite of the wide range, it has been shown that the users view the training at home, possibly even in the basement, but also in the more elaborately designed fitness studio to be rather dull in the long run.

An attempt was made to address the dullness by setting up television screens or similar entertainment equipment. However, this is not always successful because this is basically only a distraction. This can even create risks because focus on the actual physical activity is thus decreased. Depending on the type of sport, the reduced attention can also pose a safety risk (EP 3 327 597 A1). It is further known to display a virtual competitor on the screen of the training apparatus, in order to provide the user with a benchmark for the performance he generates and to thus create a type of artificial competitive atmosphere. The virtual competitor can thereby be computer-generated or can display the actual performance of other users, who train in the same room, for example in the case of an indoor cycling group, and who thus compete with one another, or who also train somewhere else remotely, and with whom there is contact via an Internet data connection (U.S. Pat. No. 8,409,057 B2).

In the case of a different design of training apparatuses, which have a stand for receiving a regular bike on the rear axle thereof, it is known to place such training apparatuses onto a platform-like foundation (U.S. Pat. No. 10,434,394 B2). The platform can be inclined and is additionally mounted in a longitudinally displaceable manner on the foundation by means of a curved roller track. The curvature of the roller track results in a stable central position, around which the platform can perform a passive oscillating longitudinal movement; the same applies for a back and forth movement as lateral inclination. The user is thus given a certain illusion of movement and the balancing ability of the user is improved.

As a whole, however, the problem remains that the pure training on the training apparatus is relatively dull and offers little feedback to the user about his training performance.

SUMMARY

The invention is based on the object of creating an improved training apparatus or fitness apparatus, respectively, by means of which said disadvantages can be reduced.

It is particularly advantageous thereby when a technical design solution can be found, which, on the one hand, provides for a simple implementation for training or fitness apparatuses, respectively, of different apparatus types, and which, on the other hand, is safer, e.g. by reducing a danger of crushing, as well as less maintenance-intensive for the user of the apparatus.

The solution according to the invention lies in the features of the independent claim. Advantageous further developments are subject matter of the dependent claims.

According to the present invention, a training or fitness apparatus, respectively, comprises a drive device for receiving a training performance generated by a user and a force transmission device for transmitting the performance generated by the user during the training to the drive device.

According to the present invention, different types of fitness apparatuses are thereby provided, such as ergometers, speed bikes, recumbent bike or recumbent ergometers, respectively, home training bikes, rowing apparatuses, elliptical trainers, cross trainers, or treadmills, wherein the fitness apparatus is embodied as apparatus of one of these different apparatus types. The technical design concept according to the invention thereby works for a fitness apparatus of each of the above-mentioned apparatus type. In other words, the technical design setup structure or platform, respectively, is unified for all apparatus types, i.e. a technical design base is created, on which externally different apparatus types can be based. This is made possible, in turn, by means of the below-described special technical design features of such a setup structure or base, respectively.

The fitness apparatus further comprises a frame, on which the drive device and a force transmission device are arranged, wherein the frame is further designed to support the user of the fitness apparatus while performing fitness exercises, as well as a pedestal supporting the frame for resting on a subsurface.

The fitness apparatus is furthermore equipped with at least one sensor for determining the training performance generated by the user as well as with a control device, wherein the control device is formed to receive data from at least one sensor. The control device thereby cooperates with a processing unit, wherein the processing unit is formed to determine a so-called measure of success from the training performance generated by the user. As will be described in detail below, a measure of success is understood to be a quantifiable measure, which provides an image of the training performance generated by the user.

The fitness apparatus also comprises a signal unit, which is formed to generate a signal for a so-called progress indicator, based on the determined measure of success. As will likewise be described in detail below, a progress indicator is understood to be a measure, which is calculated from the above-mentioned measure of success, based on a selectable reference.

The above-mentioned advantage that the fitness apparatus of each apparatus type can be produced on a setup structure or base, respectively, which is unified in terms of technical design, is due to the special features of this structure. According to this, the frame or the pedestal of the fitness apparatus has rollers, which are arranged on the frame or on the pedestal in such a way that a tilt-stable positioning of the frame with respect to the subsurface as well as a longitudinal displacement of the frame or of the frame together with the pedestal relative to the subsurface is made possible.

The fitness apparatus furthermore has at least one actuating drive, which is formed to displace the frame in the longitudinal direction relative to the pedestal or the frame together with the pedestal relative to the subsurface as a function of the signal produced by the signal unit based on the measure of success by means of the rollers in a motorized manner.

As already described, the fitness apparatus according to the invention can be formed for example as an ergometer, a speed bike, a recumbent bike, a home training bike, a rowing apparatus, an elliptical trainer, a cross trainer, or a treadmill. Such fitness apparatuses, which belong to different apparatus types, often have different dimensions. A treadmill will thus usually have a wider frame than, for example, an ergometer, speed bike, or home training bike, and a rowing apparatus or a recumbent bike (recumbent ergometer) will usually have a longer frame than an ergometer, speed bike, or treadmill. Dimensions of respective pedestals for fitness apparatuses of different apparatus types are thus also adapted accordingly. The pedestal, which is to support the frame of a rowing apparatus, can thus be embodied to be correspondingly longer and the pedestal for a treadmill to be correspondingly wider, while the technical design setup structure or construction, respectively, for training or fitness apparatuses, respectively, of different apparatus types still remains the same. Dimensions of the respective apparatus pedestal can thereby be compensated by a telescopic construction of the pedestal. The pedestal, for example for a rowing apparatus, can thus simply be extended to be longer and the pedestal, for example for a treadmill, can simply be extended to be wider.

Fitness apparatuses, such as an ergometer, a speed bike, and a home training bike (i.e. ergometer without watt functionality), in contrast, have approximately identical dimensions. The same pedestal can thus be used for apparatuses of these apparatus types. Due to a unified setup structure or base, respectively, the user can thereby easily exchange the apparatuses himself, for example an ergometer can be replaced with a speed bike. The same also applies for an elliptical trainer and a cross trainer.

In a preferred embodiment, a fitness apparatus has at least one roller, which is driven by an actuator of the actuating drive, so that a longitudinal displacement of the frame or of the frame together with the pedestal relative to the subsurface can be created.

In a further preferred embodiment, a fitness apparatus has at least one sensor for determining the training performance generated by the user. The sensor can thereby be arranged on the drive device and/or on the force transmission device.

One or several of the above-mentioned rollers can thereby preferably be embodied as a friction roller, a serrated roller, a toothed roller, a sliding roller and/or a running roller.

According to the present invention, it is particularly preferred that a fitness apparatus is embodied as an ergometer, a speed bike, a recumbent bike or a home training bike.

The pedestal of such a fitness apparatus, namely of an ergometer, of a speed bike, of a recumbent bike or of a home training bike, can thereby be formed by two cross members, on the ends of which a roller is arranged in each case, wherein the rollers rest on the subsurface, and wherein at least two rollers are driven by an actuator.

Alternatively, the pedestal can be formed by two cross members, on the ends of which sliders and/or rollers are arranged in each case, which rest on the subsurface, wherein the at least one roller driven by the actuator is arranged either as steerable central roller or as set of driven rollers on a beam between the cross members.

In a further embodiment, the rollers of a fitness apparatus, namely of an ergometer, of a speed bike, of an recumbent bike or of a home training bike, can be arranged on the frame and can run in or on guide rails of the pedestal. The at least one driven roller is thereby formed to displace the frame relative to the stationary pedestal and thus also relative to the subsurface.

It is preferred that the processing unit of the fitness apparatus is formed to control the actuating drive in a reversible manner.

It is further preferred that the signal unit of the fitness apparatus cooperates with an amplifier module, which is formed to consider an acceleration generated by the training performance for the progress indicator.

It is furthermore preferred that the actuating drive of the fitness apparatus is provided with an end position detection, which is formed to turn off and/or to reverse the actuating drive when reaching an end position. The actuating drive can thereby be embodied in a form-fit manner.

In a further preferred embodiment, the actuating drive of the fitness apparatus is embodied as creep drive, which drives the at least one roller at a speed, which is lower than walking speed and is maximally 1 m/s.

It is further preferred that the actuating drive of the fitness apparatus has a traction control for the at least one driven roller, wherein a detected slip of the at least one driven roller is guided back to the processing unit.

In a further preferred embodiment, the actuating drive of the fitness apparatus has a device for position detection, which is formed to output a signal to the processing unit.

The device for position detection preferably has a sensor, wherein the sensor is formed to detect floor track markings. The floor track markings can thereby be formed as track markings with distance markings.

The floor track markings can thereby be formed as marking tape. The marking tape can thereby be arranged on the subsurface.

The fitness apparatus can furthermore have an alignment module, wherein the alignment module is formed to detect and display directional deviations by means of the floor track markings.

In a preferred embodiment, the alignment module is formed to display a correction direction.

The above-described preferred features of the training or fitness apparatus, respectively, according to the invention contribute to the user of the fitness apparatus being able to experience an intensified illusion of training success, which leads to an increased training performance and thus also to the improved actual fitness of the user.

The rollers of the fitness apparatus can furthermore be arranged on the frame or on the pedestal in such a way that, for example, a crushing danger-minimizing longitudinal displacement of the frame or of the frame together with the pedestal relative to the subsurface is made possible. The frame of the fitness apparatus is arranged relative to the pedestal with the help of rollers so that the extremities of the user, for example his feet, can normally not get trapped or crushed, respectively, between the frame and the pedestal, in contrast, for instance, to a device known from the publication KR 20190029151 A. This safety aspect is important especially when the user uses the fitness apparatus without supervision of another person, for example without supervision of medical personnel in hospitals or doctors' offices, which is usually the case in the fitness studios or at home.

Additional advantages of the fitness apparatus according to the invention become evident using the example of a below-described ergometer.

In the case of an ergometer, in particular bike ergometer, with a tilt-stable frame, on which a seat for a user and a pedal unit to be actuated by the user are arranged, and a pedestal supporting the frame with feet for resting on a subsurface, wherein the pedal unit acts on a braking device, and a control device is provided, which controls the braking device and to which at least one sensor for determining a training performance generated by the user is connected, it is provided according to the invention that the control device cooperates with a processing unit, which is formed to determine a measure of success from the training performance generated by the user with respect to a training reference, as well as with a signal unit, which generates a signal for a progress indicator based on the measure of success, and an actuating drive is provided, which displaces the frame with seat and pedal unit in the longitudinal direction in a motorized manner (so that the relative position thereof to the subsurface changes), wherein the actuating drive is controlled automatically by the processing unit as a function of the signal for the progress indicator.

Some used terms will initially be explained below:

An ergometer is usually understood to be a training apparatus, which is embodied for being used in an interior space (fitness studio, room in the home of the user). It goes without saying that an ergometer can also be set up outdoors.

A pedal unit is understood to be that device, with regard to which the user predominantly exerts his training force. This usually takes place by means of the lower extremities, such as legs or feet, respectively, for example in the case of the stationary bike or bike trainer, respectively, indoor cycling bike (in particular without freewheeling), treadmill training apparatus or cross trainer. However, this term is to be understood in the broadest sense and is to also refer to the upper extremities, as used in particular in the case of the rowing apparatus or similar training apparatuses for exerting the training force.

A pedestal is understood to be that component of the supporting structure of the ergometer, with which the ergometer stands on a support, in particular the floor of the room or of the fitness studio.

The longitudinal direction is a direction, which is oriented predominantly parallel to the support (horizontally), namely approximately along a longitudinal axis of the ergometer.

Depending on the type of the ergometer, the training force exerted by the user results in certain training work, wherein the quotient thereof by time results in the training performance.

The training force exerted by the user and the training performing resulting therefrom cannot readily be dissipated in the case of an ergometer, which is located in an interior space, in contrast to, for example, in the case of a bike, which is moved in the open in nature, in the case of which the training performance is expended to increase the riding speed and to overcome the air resistance. In the case of an ergometer, a braking device replaces these natural resistances. Said braking device can be formed in a variety of inherently known ways, for example as friction braking device, as magnetically acting braking device, as a generator for generating electrical energy, or as a braking device acting against a fluid (for example a fan or elements rotating in a water vessel).

A measure of success is understood to be a quantifiable measure, which provides an image of the training performance generated by the user. For example in the case of a bike ergometer, this can thus be the speed and/or the covered riding distance, in the case of a treadmill training apparatus this can be the speed and/or the reached incline, in the case of a rowing apparatus this can be the covered rowing distance or the reached boat speed, etc., It can be an absolute measure or a relative measure with respect to a selectable and/or predetermined training reference. The training reference can be created artificially, for example calculated by a processor of the ergometer, it can result from stored history (for example previously reached training performance of the user), and/or it can also result from training performance of other users, who previously used the same apparatus or who use or have used, respectively, another similar apparatus, which is connected to the ergometer, for example via a (remote) data connection, in particular the Internet.

The progress indicator is a measure, which is calculated from the measure of success, based on a selectable reference. In the case of a bike ergometer or a treadmill training apparatus, for example, this can be the ratio of the covered distance to a predetermined target distance as reference, for example which portion of a 10,000 meter race has already been mastered or which portion of a 50 km bike training. However, this can also be a relative measure, for example the reached progress relative to a different training, for example one's own previous training (running against oneself) or against the training performance of another user on another training apparatus.

The motorized displacement of the frame with seat and pedal unit in the longitudinal direction is understood such that, viewed in the longitudinal direction of the training unit, the relative position of the frame with seat and pedal unit to the subsurface, on which the ergometer training apparatus is arranged, changes.

An actuating drive is understood to be a servo drive with a control unit, which changes the position of a component of the ergometer training apparatus (optionally of the entire apparatus) by a predetermined amount in a predetermined direction (by the construction of the ergometer) in a controlled or regulated manner. Typically, a position feedback exists thereby, in the case of which the position change effected by the servo drive is determined and is guided back to a control unit of the servo drive. The energy required for the servo drive can preferably be taken from a separate energy storage of the ergometer training apparatus or can be generated by means of a generator (for example auxiliary generator on the braking device or generator as braking device); however, a supply from the outside by means of power cord or the like is to not be excluded.

It is attained by means of the invention that the user situated on the ergometer does move slowly but noticeably, depending on his training performance. The result of his effort is made clear directly to the user in this way, which has a motivating effect on the user. An incentive for continuing to generate the training performance is thus created, in that in this way, the user can determine intuitively by means of the movement effected by the actuating drive, what and how much he has accomplished. This applies equally for an individual user, to whom the completed portion of a predetermined training spectrum is made clear and tangible in this way. However, this also applies in particular for an increase of the comparability in the case of several users, for example in a fitness studio, where the user with the highest training performance advances slowly in this way ahead of the other users with a lower training performance. However, if this user slows down and thus loses his lead position and slips into positions further back, this can be made clear to him in that the actuating drive no longer moves (while the other users, who have now become faster, are moved forward) or is even moved backward. A competitive atmosphere can be created in this way in the fitness studio or in the home studio, whereby the danger of monotony, which occurs otherwise during prolonged use or training, respectively, can be counteracted effectively.

Thanks to the invention, the user can detect immediately and physically perceptibly, where he stands with regard to a training task and/or what his position is based on other participants, whereby increase (or decline) of his training performance are made clear to him by adjusting the actuating drive.

The user experience is thus improved and a physically perceptible comparability with the training performance of other users (or of himself, for example based on an earlier exercise of the same user) is thus created. This has a motivation-increasing effect and keeps the joy of exercising going.

The actuating drive is advantageously controlled in a reversible manner, in particular by the processing unit. It can be attained therewith that, depending on his training performance, the user cannot always just be moved forward, but also in the opposite direction, thus backward. The latter makes it clear to the user that his training performance has decreased. The previous performance of the user, a specified reference or the training performance of other users can act as reference here.

The signal unit advantageously cooperates with an amplifier module, which is formed to consider further parameters for the progress indicator, in particular an acceleration and/or speed generated by the training performance. In that for example the acceleration, thus the increase of the training performance of a user, is evaluated by the amplifier module in addition to the reached position, the most recent performance increase of the user can be displayed quasi in an enlarged manner by means of a stronger movement of the actuating drive. This thus results in a type of magnifying glass effect, in the case of which the battles of two users for positions are emphasized clearly and even small progress is in each case made clear by means of the enlargement effected by the amplifier module, thus resulting in a special motivational effect. If, for example on a 10 km distance, a user is 1 m behind another user, this basically has a hardly noticeable effect on the actuating drive (position difference is only 0.1%). However, if this user picks up his pace significantly and can thus manage to now be 1 m in front of the other user, this performance can be emphasized by means of the amplifier module by means of a stronger adjustment of the actuating drive (for example by means of a 10- or even 50-fold increase); if the other user catches up again, the same applies or the first user is moved back again, respectively. Battles for positions or other small changes then become well visible even if these are actually large distances.

The amplifier module is preferably further formed to perform a compression in the time domain. The adjustment can thereby not only take place continuously but can optionally even take place discontinuously. During the discontinuous adjustment, a forward adjustment takes place in a pulse-like manner, for example in the case of a corresponding training performance of the user. The acceleration resulting therefrom intensifies the effect experience for the user. In the case of a consistent training performance of the user, a return can then take place (imperceptibly) slowly, in order to optionally be able to subsequently adjust forward with a pulse again. In the case of a drop in performance, a backward adjustment is optionally also performed quickly again.

The actuating drive is advantageously provided with an end position detection, which is formed to turn off and/or to reverse the actuating drive when reaching an end position. An exceeding of a maximum deflection of the actuating drive is thus avoided, which benefits the operational safety and/or stability of the ergometer.

It is expedient when the actuating drive is embodied in a form-fit manner. Even though it is not ruled out that it also works in a non-form-fit manner, an actuating drive embodied in a form-fit manner simplifies the precise reaching of a predefined position. Incorrect positioning due to slip, as they can occur in the case of actuating drives based on frictional engagement, can be virtually ruled out in this way.

The actuating drive is preferably arranged between frame and pedestal, so that the frame can be displaced relative to the pedestal. This makes it possible to integrate the actuating drive in a space-saving manner in the pedestal. In addition, this thus results in a low center of gravity. On the other hand, however, it is to not be ruled out that the actuating drive is arranged on the displaceable frame. This embodiment can be expedient if relatively large adjustment paths for the actuating drive are provided and/or the actuating drive comprises long guides, in particular telescopic guides.

Alternatively, it can also be provided, however, that the pedestal is provided with roller feet and the actuating drive is arranged on the pedestal, wherein the actuating drive drives at least one of the roller feet. A roller foot is thereby understood to be a foot, with which the pedestal stands on the floor, wherein the foot is thereby not a rigid body but is provided with a roller. By driving at least one of the roller feet, the ergometer can thus be displaced as a whole with the entire frame by the actuating drive. The actuating drive is expediently embodied as a creep drive, which drives the at least one of the roller feet at a low speed, which is lower than walking speed, preferably maximally 1 m/s or maximally at a safe speed, respectively, as it is defined according to relevant machine guideline. A danger arising from an ergometer, which moves too quickly, is thus counteracted in the confined surroundings of a room or of a space within a building.

All feet of the pedestal are expediently embodied as roller feet, at least one of which, preferably two, are driven by the actuating drive. In the case of two driven roller feet, one is preferably arranged on the left and one on the right of the pedestal, viewed in the longitudinal direction.

The actuating drive advantageously has a traction control device for the roller foot, wherein detected slip of the at least one driven roller foot is preferably guided back to the processing unit. Especially on the smooth floor, which can often be found in fitness studios, there is the danger that the actuation of the actuating drive leads to slip on the roller foot, whereby the desired displacement in the longitudinal direction is not attained or only incompletely. The danger of occurring slip is even exacerbated in that accumulations of sweat or puddles of sweat typically form on the floor in the region of the ergometer in response to great effort from the user, whereby the floor becomes slippery and the danger of occurring slip increases. In order nonetheless attain the desired displacement in spite of slip, the slip is expediently determined and is guided back to the processing unit, which is expediently formed to be able to compensate the slip. It is expedient to determine the slip by means of a comparison of the displacement distance resulting during a slip-free actuation of the actuating drive, to the actually covered displacement distance. Several roller feet are preferably driven and detected slip is compensated. For this purpose, it is in particular provided that that roller foot, in the case of which slip occurred, is additionally driven, in order to thus attain the desired slip compensation.

The roller feet are advantageously spring-loaded. It is attained therewith that the roller feet stand firmly on the floor even in the case of a not completely flat subsurface, as it can often be found in the home environment, and thus provide for a low-slip or slip-free actuation, respectively, of the actuating drive.

The actuating drive is expediently provided with a device for position detection, the signal of which is guided back to the processing unit. A precisely defined displacement distance can be set and attained securely by means of the actuating drive. For this purpose, it can in particular be provided that the device for position detection is provided with a sensor, which is formed for detecting floor markings. The floor of the room or of the fitness studio can thus expediently be used for the position detection.

The floor markings are preferably embodied as a marking tape, which can more preferably be adhered to the support. The required marking of the floor can thus be created in a simple way in any space or room, namely in that the tape is simply unrolled on the floor and is optionally fastened by means of gluing.

It is particularly advantageous when the floor markings are embodied as a track marking with distance markings. A determination of the reached displacement distance can take place by means of the distance markings as well as an ensuring the straightness of the displacement distance by means of the track marking. The securing of the straightness of the displacement distance is significant in particular in those cases when several ergometers are arranged relatively closely next to one another, as is typically the case in fitness studios. An overlapping of the displacement distance can be avoided by means of parallel alignment of the ergometers, but only if the displacement distance of the respective ergometer is straight and deviations from it do not occur. This can be attained in that the floor markings are embodied as track marking for the respective ergometer.

An alignment module can advantageously be provided, which is formed to detect and to display directional deviations by means of the floor markings, wherein a correction direction is further preferably displayed. It can thus be detected by means of such an alignment module when the actually resulting displacement does not exactly follow the provided trajectory according to the floor markings. This can be displayed to the user. He can then optionally manually correct the position and/or alignment of the ergometer, or this can take place automatically, in particular by means of one-sided driving of the roller feet. This can take place in such a way that the displacement along a straight line, which is effected by the actuating drive, is monitored and optionally corrected in an automated manner. For this purpose, the correction device preferably acts on at least two roller feet and controls them at a differential speed, which is a function of a desired correction effect. The desired straight course of the displacement distance can thus be attained automatically.

A separate energy source, in particular a storage and/or (auxiliary) generator, is provided for the actuating drive on the ergometer. The ergometer becomes independent of an external energy supply in this way. This is a considerable advantage in particular for the alternative with roller feet because there would otherwise be the risk that, depending on the displacement distance, energy supply cables would be too short or would form a trip hazard for users. A cable-free supply is further advantageous in the case of several ergometers, which are set up next to one another, in order to avoid a mutual obstruction.

It is expedient to provide transport rollers on the pedestal, which are preferably not driven. The transport rollers enable the user, for example after the training, to easily displace the ergometer, in order to put it away. The transport rollers are preferably arranged so that they reach the floor only when the pedestal is raised on one side and thus enable a rolling away, while they are spaced apart from the floor in the case of a pedestal, which is located completely on the floor, so that the pedestal cannot roll away but stands immovably in its place.

The ergometer can in particular be a bike, a rowing apparatus, or a treadmill. In the case of the first, the user spot is formed by a seat, while the treadmill by nature does not have a seat but the user spot replaces the seat, which, by design, is defined by the point on the treadmill, at which the user is located on the treadmill during actuation. In the case of a rowing apparatus or in the case of the treadmill, pedal unit is to be understood to be the corresponding actuating actuators (the rowing handles or the moving treadmill, respectively).

The invention further extends to a corresponding method for operating the ergometer, in particular a controlling of the actuating drive. It further also relates to a method for operating an ergometer, in particular bike ergometer, with a tilt-stable frame, on which a seat for a user and a pedal unit are arranged, and a pedestal supporting the frame, with feet for resting on a subsurface, wherein the pedal unit acts on a braking device, comprising an actuation of the pedal unit by the user, a determination of a training performance generated by the user by means of a sensor, and a control of the braking device by means of a control device, to which the sensor is connected, wherein what is further provided according to the invention is a determination of a measure of success from the training performance generated by the user with respect to a training reference, generation of a signal for a progress indicator based on the measure of success, and automatic controlling of an actuating drive as a function of the signal for the progress indicator, whereby the actuating drive displaces the frame with the seat and the pedal unit in the longitudinal direction in a motorized manner.

The method further comprises an exchange of data, in particular comprising training data and/or data for the measure of success, with other ergometers via a networking unit. A generation of the training reference based on users on the other ergometers can preferably further be provided. The other ergometers can be located locally, for example in the same fitness studio when networking in particular via LAN, WLAN, or Bluetooth, or remotely, when networking in particular via a WAN (Wide Area Network) or the Internet, respectively. The actuating drive of the respective ergometers is further preferably adjusted so that the ergometers are positioned according to a relative placement of the users. By comparing the respective measure of success and/or progress indicator of the participating users, a relative placement can be determined, possibly optionally by including the amplifier module as described above. Virtual competitions with other users can be performed in this way on further ergometers. Depending on the performance, the user can thus be moved forward by the actuating drive, if he is better (has a higher measure of success) than the other users, or he can be moved backward, if he is worse, thus falls behind relative to the other users. This can be made to be experienced highly vividly by the user, which increases the motivation and thus also the training performance.

With regard to the further description of the method, reference is moreover made to the above description relating to the device, which therefore analogously also applies for the method, in order to avoid repetitions.

It can preferably further be provided for the device and method that the other ergometers are substations and communication signals, such as receiving training instructions and sending corresponding responses, are exchanged via the networking unit. This provides advantages in particular when one of the ergometers acts as master, for example when it is a trainer or exercise instructor station, from where one or several substations with users, who are training, are controlled.

In the present case, the term "exchanging" is understood to be unidirectional as well as bidirectional data traffic.

BRIEF DESCRIPTION OF THE DRAWING

The invention will be described below in an exemplary manner with reference to the drawing on the basis of advantageous embodiments, in which.

DETAILED DESCRIPTION

Figure 1A:
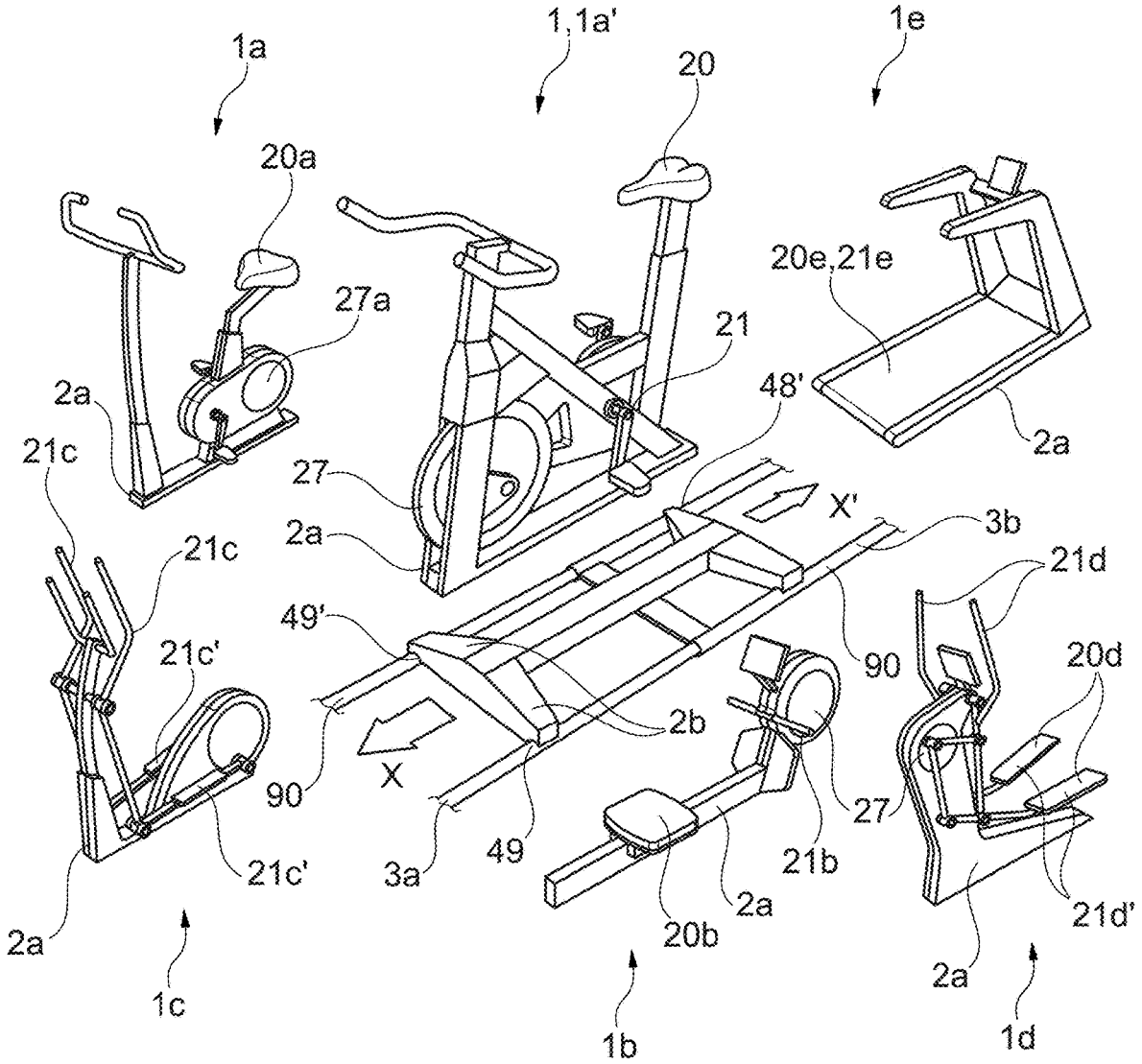
FIG. 1*a, b* show perspective general views of a base according to the invention, which is unified in terms of technical design, for fitness apparatuses of different apparatus types with concealed and open rollers.
Figure 1B:
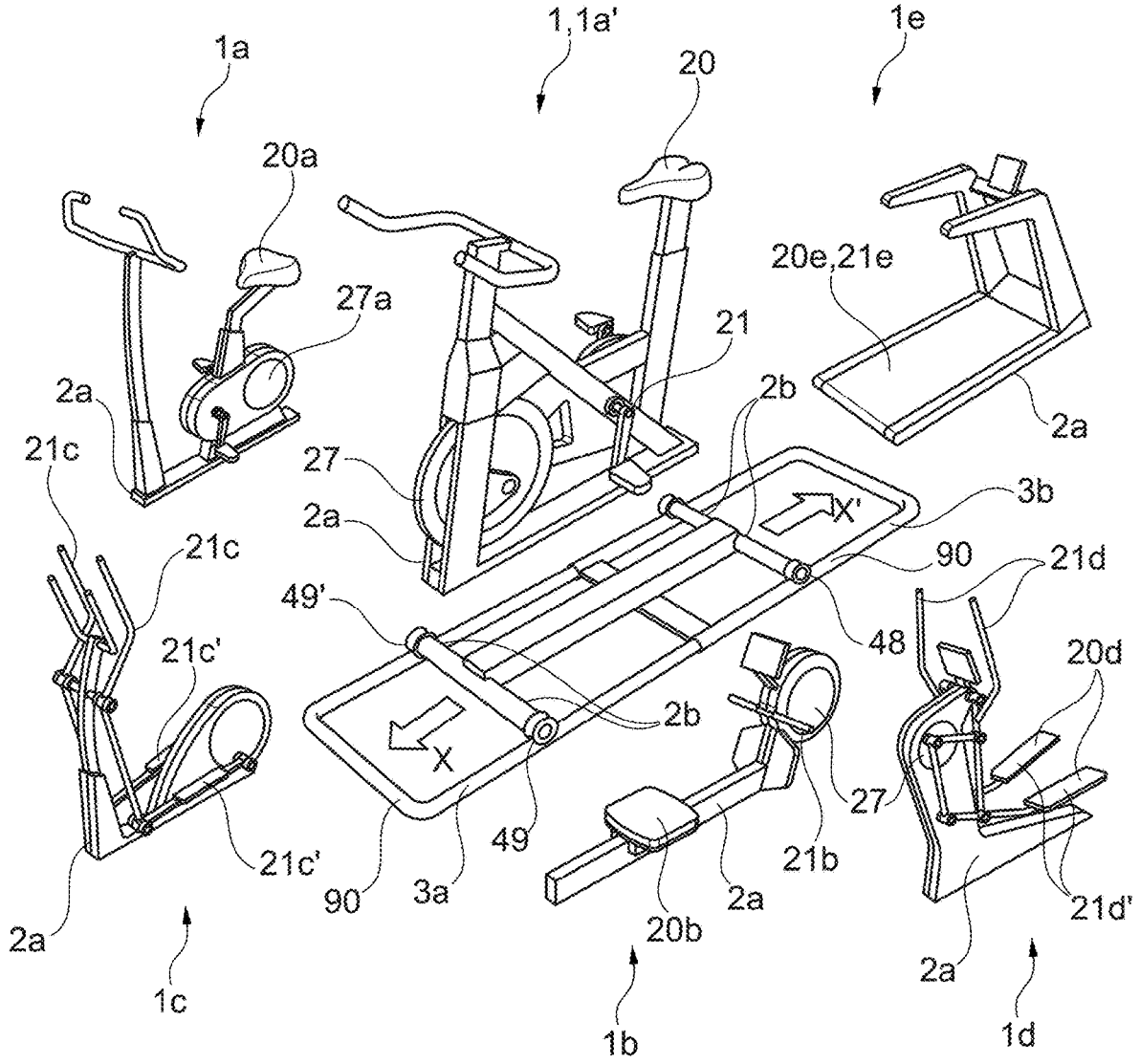
FIG. 1*c-h* show perspective general views of embodiments accordingly for the elliptical trainer, the rowing apparatus, the cross trainer, the speed bike, the ergometer, and the treadmill.
FIG. 1*i* shows a perspective general view of a further embodiment for the ergometer.
Figure 1C:
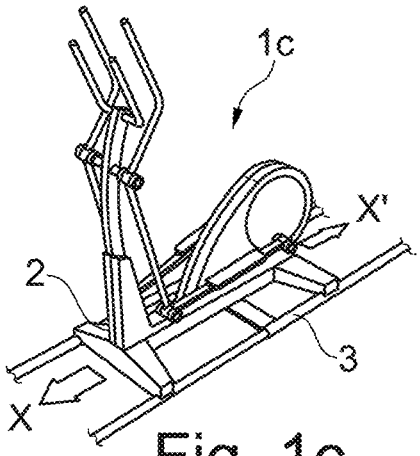
Figure 1D:
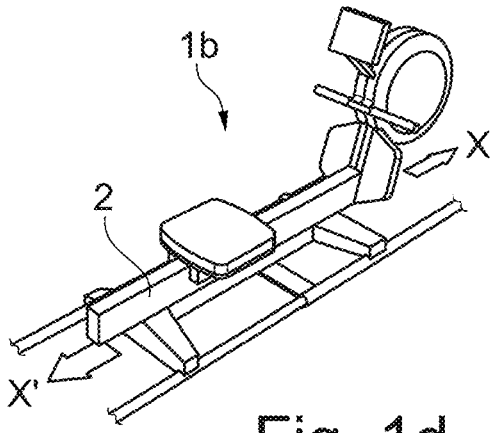
Figure 1E:
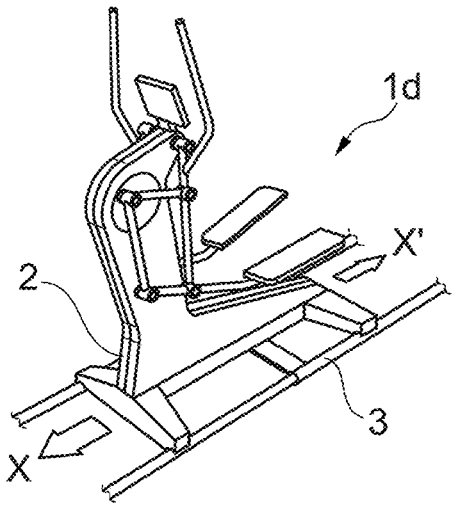
Figure 1F:
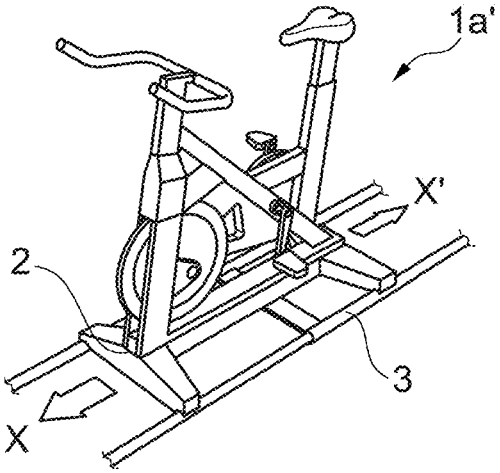
Figure 1G:
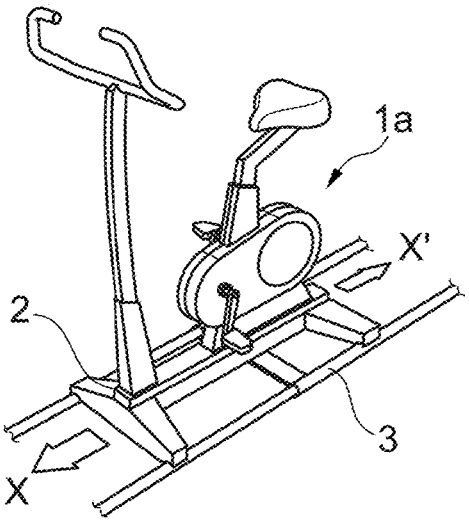
Figure 1H:
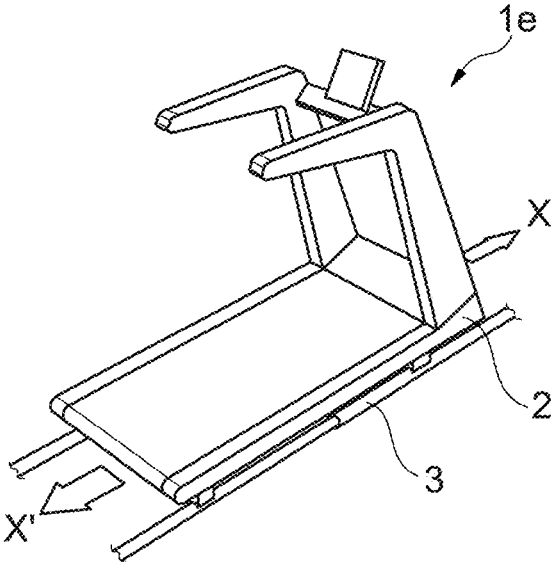

FIGS. 1*a* and 1*b* show perspective general views of examples of a base or setup structure, respectively, which is unified in terms of technical design, for fitness apparatuses 1 of different apparatus types 1*a*, 1*b*, 1*c*, 1*d*, 1*e*, namely structures with concealed (FIG. 1*a*) and open (FIG. 1*b*) rollers 48, 49, 48', 49'.

The fitness apparatus 1 comprises a drive device 27, for receiving a training performance (which can be synonymously called also a "training output"); generated by a user, and a force transmission device 21 for transmitting the performance generated by the user during the training to the drive device 27.

The present invention thereby provides different types of fitness apparatuses 1, e.g. ergometers 1*a*, speed bikes 1*a'*, recumbent bikes or recumbent ergometers, respectively, home training bikes, rowing apparatuses 1*b*, elliptical trainers 1*c*, cross trainers 1*d*, or treadmills 1*e*. The fitness apparatus 1 is embodied as apparatus of one of these different apparatus types 1*a*, 1*a'*, 1*b*, 1*c*, 1*d*, 1*e*. However, the technical design setup structure or base, respectively, is embodied uniformly, i.e. unified, for all apparatus types 1*a*, 1*a'*, 1*b*, 1*c*, 1*d*, 1*e*.

FIGS. 1*c* to 1*h* show detailed views for the setup of the fitness apparatuses 1 of different apparatus types 1*a*, 1*a'*, 1*b*, 1*c*, 1*d*, and 1*e*.

The fitness apparatus 1 also comprises a frame 2, 2*a*, 2*b*, on which the drive device 27 and a force transmission device 21 are arranged, wherein the frame 2, 2*a*, 2*b* is further designed to support the user of the fitness apparatus 1 while performing fitness exercises, as well as a pedestal 3, 3' supporting the frame 2 for resting on a subsurface.

As a rule, the drive device 27 has a controllable braking device, so that the user of the fitness apparatus 1 can either set his training load himself during the exercises or so that the fitness apparatus 1 can specify a training load, which is optimized for the training success, for the user.

The force transmission device 21 can be embodied differently for apparatuses 1 of different apparatus types, e.g. as a pedal unit 21, 21*a* in the case of an ergometer 1*a* or a speed bike 1*a'*, a pull rope 21*b* in the case of a rowing apparatus 1*b*, as running arms, including movable arms 21*c*, 21*d* and pedal arms 21*c'*, 21*d'*, in the case of an elliptical trainer 1*c* and a cross trainer 1*d*, or as running belt 21*e* in the case of a treadmill 1*e*.

The frame 2 or the pedestal 3' of the fitness apparatus 1 formed by two cross members 32, 33 thereby has rollers 48, 49, 48', 49', which are arranged on the frame 2, 2*b* or on the pedestal 3, 3' in such a way that a tilt-stable positioning of the frame 2 with respect to the subsurface as well as a longitudinal displacement X, X' of the frame 2 or of the frame 2 together with the pedestal 3, 3' relative to the subsurface is enabled.

Such a longitudinal displacement X, X' of the frame 2 relative to the pedestal 3 or of the frame 2 together with the pedestal 3' relative to the subsurface is thereby ensured with the help of at least one actuating drive 9 as a function of a measure of success of the user training.

The fitness apparatus 1 furthermore has at least one sensor 26 for determining the training performance generated by the user and a control device 6, wherein the control device 6 is formed to receive data from at least one sensor 26. The control device 6 thereby cooperates with a processing unit 7, wherein the processing unit 7 is formed to determine a so-called measure of success from the training performance generated by the user. The fitness apparatus 1 also comprises a signal unit 8, which is formed to generate a signal 80 for a so-called progress indicator, based on the determined measure of success, whereby the above-mentioned longitudinal displacement X, X' of the frame 2 relative to the pedestal 3 or of the frame 2 together with the pedestal 3' relative to the subsurface is controlled.

The embodiments for the ergometers according to the invention illustrated in FIGS. 1*i* to 13 are bike ergometers. However, the invention is not limited thereto and can also be provided for other types of fitness apparatuses or other types of ergometers, respectively, in particular recumbent bike ergometers, treadmill ergometers, cross trainer and/or rowing apparatus ergometers.

Figure 1I:
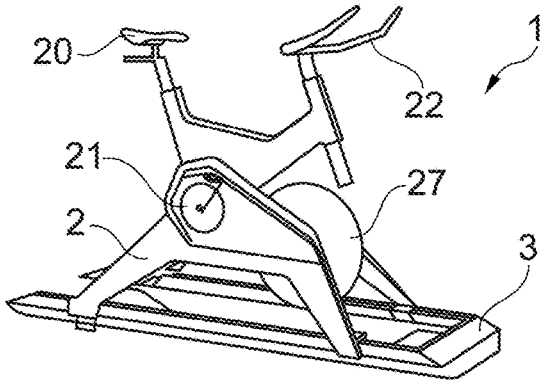

A bike ergometer according to a first embodiment of the invention, as illustrated in FIG. 1*i*, comprises a frame 2 as main component, on which a seat 20 for a user and a hand grip 22 embodied in the manner of a handlebar are arranged, as well as a pedestal 3, which supports the frame 2 and on which the frame 2 is arranged in a tilt-stable manner. The pedestal 3 is provided with feet 4, by means of which it stands firmly on a floor or another suitable support. A pedal unit 21 is further assigned to the seat 20 and is arranged so that a user sitting on the seat 20 can actuate the pedal unit 21 with his legs and can thereby support himself on the hand grip 22. The user uses the pedal unit 21 to apply the training performance (or synonymously "training output", which is then received via the pedal unit 21 and is fed into the bike ergometer and is typically absorbed by a braking device 27. In the illustrated exemplary embodiment, the braking device 27 is embodied as a magnetic braking wheel, but other alternative types of braking devices known to the person of skill in the art are also possible, with braking bands or braking devices acting as a generator being mentioned representatively here as examples.

The frame 2 is longitudinally displaceable with respect to the pedestal 3 by means of an actuating drive 9, which is installed so as to be largely concealed in the case of the illustrated embodiment (not illustrated in FIG. 1). Based on a central position, as it is illustrated in FIG. 1, the position of the frame 2 with the user located on the seat saddle 20 can thus be changed forward in the longitudinal direction (in FIG. 1 to the right) and preferably also in the opposite direction, thus backward in the longitudinal direction (in FIG. 1 to the left) on the pedestal 3 by means of actuating drive 9.

Figure 2:
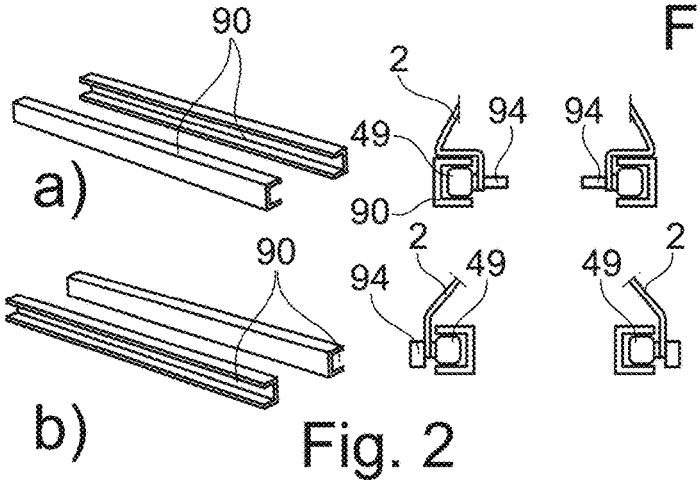
FIG. 2*a, b* show perspective illustration and sectional illustration for guiding a frame on a pedestal of the ergometer.
Figure 3:
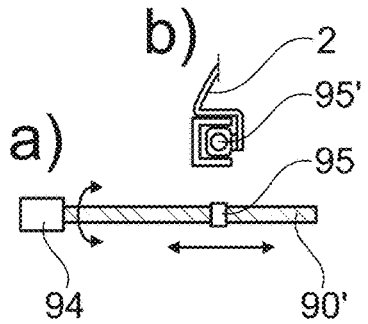
FIG. 3*a, b* show an alternative for guiding the frame on the pedestal.
Figure 4:
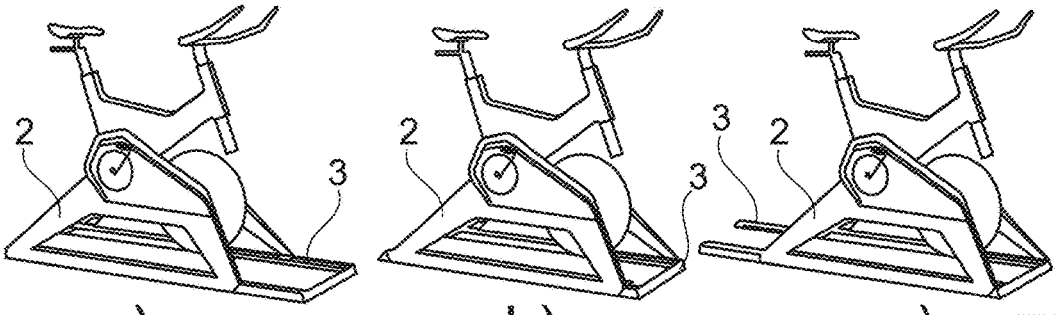
FIG. 4*a-c* show views relating to a rear, central, and front position of an actuating drive of the ergometer.
Figure 5:
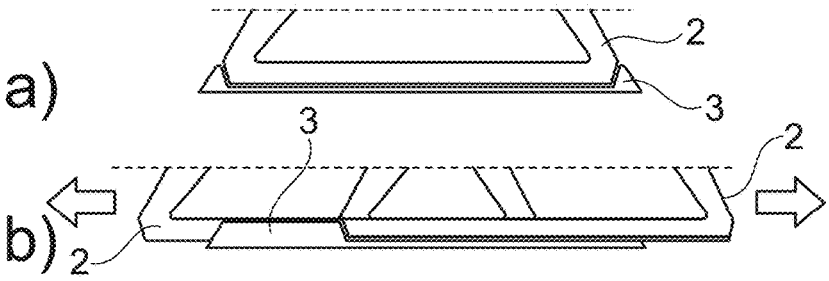
FIG. 5*a, b* show detail views relating to a displacement of the frame relative to the pedestal.

Details relating to a guide of the actuating drive 9 are illustrated in FIGS. 2*a* and *b*. The guide comprises a pair of guide rails 90, which are formed in a U-shaped manner and which are arranged in opposite directions on the longitudinal sides of the pedestal 3. In opposite directions is thereby understood that in the case of the guide rails 90, the open side of the "U" are in each case both arranged inwards (see FIG. 2*a*) or both outwards (see FIG. 2*b*). Two rollers, the one roller 48 of which (not illustrated in FIG. 2) is not driven and the other roller 49 of which is driven by means of an actuating motor 94 of the actuating drive 9, run in the guide rails 90 on each side. In that the actuating drive 9 drives the roller 49 by means of the actuating motor 94, the roller 49 and thus also the non-driven roller 48 moves along the guide rails 90, whereby the frame 2 displaces accordingly relative to the pedestal 3, which is stationary.

The embodiment alternatives according to FIGS. 2*a* and 2*b* differ only with regard to the orientation of the guide rails 90 and in whether the actuating motors 94 run on the inside or on the outside. The rollers 48, 49 can be embodied with a smooth jacket surface, wherein the traction between the driven roller 49 and the inner side of the guide rails 90 is based on friction; alternatively, at least the driven roller 49 can optionally be embodied as serrated roller with a corresponding complementary design of the inner side of the guide rails 90, whereby the drive effect is based on a form-fit connection.

A further alternative for the actuating drive 9 and the guide thereof is illustrated in FIG. 3*a, b*. Instead of the guide rails 90, a guide spindle 90' is provided thereby, which is rotated by an actuating motor 94. A frame-mounted sliding block 95, which has a passage opening with an internal thread 95', is arranged on the spindle 90'. The spindle is guided through said internal thread, wherein the internal thread 95' engages with the spindle 90'. By rotating the spindle 90' by means of the actuating motor 94, the sliding block 95 and thus the frame 2 can be adjusted in a positionally accurate manner in the longitudinal direction. By rotating in one direction, the frame can be moved forward, and the frame 2, in turn, can accordingly be moved backward relative to the pedestal 3 by rotating the spindle 90' in the other direction. The spindle 90' can likewise be installed so as to be concealed, for example in the interior space of a U-profile with a respective opening pointing inward, as illustrated in FIG. 2*a*.

Examples for the positions of the frame 2 relative to the pedestal 3, which can be reached by means of the actuating drive 9, are illustrated in FIGS. 4*a* to *c*. They show views of the frame 2 in the case of a rear (FIG. 4*a*), central (FIG. 4*b*), and front position (FIG. 4*c*) of the actuating drive 9 of the ergometer. It can be seen clearly, how the relative position of the frame 2 with the seat 20 of the user can be displaced forward or backward, based on the pedestal 3 standing on the support (floor). As a rule, the central position (FIG. 4*b*) thereby represents the starting point. Based on the FIG. 4*b*, a positive achievement of his training goal, in particular also an overachievement, can thus be shown directly and vividly to the user by means of an adjustment of the actuating drive 9 in the direction that the frame 2 and thus also the user is displaced further forward, as symbolized in FIG. 5*b* by means of the arrow pointing to the right. For generating a maximum performance or for generating the lead position, respectively, during a competitive competition, the frame 2 can thus accordingly be moved all the way to the front, as it is illustrated in FIG. 4*c*. The user can thus be positively reassured and encouraged in this way to generate his training performance. If, in contrast, the training performance of the user falls short of the provided training performance or his training goal, respectively, this can accordingly likewise be shown directly and vividly to the user by means of a backward movement of the frame 2 with the user sitting there, as it is symbolized by means of the arrow pointing to the left in FIG. 5*b*. When not generating the training performance or when remaining in last place of a competitive competition, respectively, the frame 2 with the user is then accordingly moved all the way to the back, as illustrated in FIG. 4*a*. The user can thus be encouraged in a silent yet nonetheless noticeably and intuitively comprehensible manner to increase his training performance.

If the performance of the user lies within the average or expected range, the frame 2 can thus assume the central position again, as illustrated in FIG. 5*a*. This creates the basis for making it possible for the user to experience his training performance again in the further course with respect to overachieving/underachieving by corresponding adjustment of the position of the frame 2 (and thus also of the user located on said frame).

The schematic setup and the functional contexts of the essential components will be described below on the basis of the block diagram according to FIG. 6. The control device 6 is the central unit for the basic function of the ergometer.

An input device 23 as well as a display device 24 as operator display are connected to said control device via a user interface 25. A sensor 26, which is connected to the control device 6 and by means of which the control device 6 determines the training performance generated by the user, is further arranged on the pedal unit 21. The control device 6 is preferably further formed to determine signals, by using the data gathered by the sensor 26, in order to generate from the training performance generated by the user a measure for a distance s covered by the user, the speed v reached thereby, and optionally also possible acceleration/delay a.

The control device 6 further cooperates with a processing unit 7. The signals from the control device 6 are applied to said processing unit, in particular the training performance generated by the user, the covered distance, speed as well as acceleration. A signal for a training reference, as it is set by the user via the input device 23, is further applied thereto. From the training performance generated by the user, the processing unit 7 determines, with respect to the training reference, a measure of success, which can be absolute and/or relative. For this purpose, the processing unit 7 cooperates with a signal unit 8, which is formed to generate a signal 80 for a progress indicator 81, based on the measure of success. The signal 80 is output and is applied as input signal to an actuating drive 9, which, depending on this signal 80, displaces the frame 2 with seat 20 and pedal unit 21 in the longitudinal direction in a motorized manner as a function of the generated training performance, as will be described below. Processing unit 7 and actuating drive 9 form the actual core of the invention.

The actuating drive 9 has an actuating motor 94, which, for displacement by means of a driven roller 49, acts on the frame 3. A non-driven roller 48 is further illustrated, which is provided with a device for determining the rotation (encoder or resolver) 96. The signal generated by said device is a measure for the distance covered by the roller 48, thus a signal for the displacement of the frame 2 and is guided back to the actuating drive 9. The speed of the actuating motor 94 is preferably likewise monitored, from which a signal for the speed of the driven roller 49 can be generated. This signal is likewise guided back to the position drive 9. The latter comprises a traction control device 93, to which both the speed signals of the driven roller 49 as well as the speed signals of the non-driven roller 48 are applied. It can be determined therefrom whether and to what extent slip occurs on the driven roller 49, a corresponding compensation can further take place when slip is detected, in particular by means of additional actuation of the roller 49, which is subject to slip, by means of the actuating drive 9 and/or—in the case of two or more driven rollers—by means of complementary control of the actuating drive on the opposite side of the frame 2, in order to create symmetry in this way.

Figure 6:
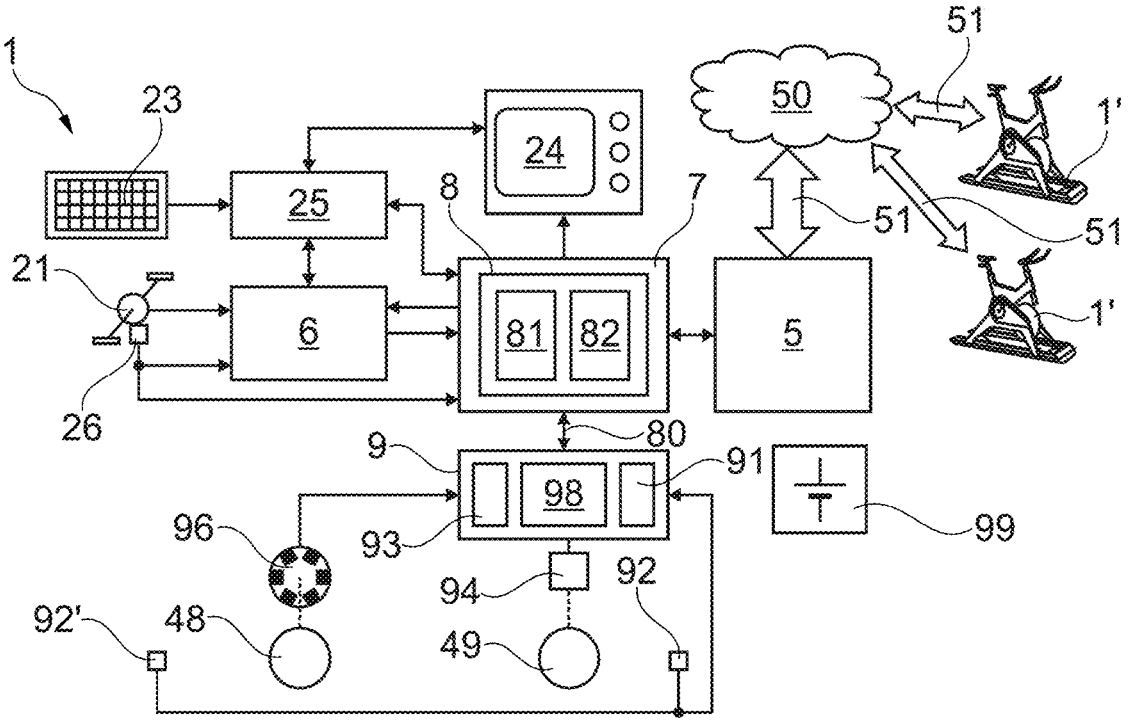
FIG. 6 shows a schematic block diagram for the ergometer with actuating drive.

The actuating drive 9 further comprises limit switches 92, 92', which are arranged in the region of the ends of the guide rails 90 (not illustrated in FIG. 6). They are connected to the actuating drive 9 via a stop switch device 91. The stop switch device 91 is formed to detect the approaching of the rollers 48, 49 to the respective end switch 92, 92' and to then turn off or to reverse the actuating drive 9. It can be prevented with this that the frame 2 is displaced too far and the danger of jumping out of the guide rail 90 can thus be minimized.

The signal unit 8 further cooperates with an amplifier module 82. Signals for speed and/or acceleration, as they are determined by the control device 6 from the training performance generated by the user, are additionally applied to said amplifier module. Said signals can be considered as further parameters for the progress indicator. For example, a catching-up of the user based on a training reference as well as an exceeding of the training reference can thus be intensified, so that even small progress is intensified by the amplifier module 82 in this way and is made clear for the user thereby. This applies accordingly when the training reference is formed by further users on other ergometers 1', in particular when position struggles of two users result. If a user catches up, based on another user, even small progress while catching up is made visible more strongly by means of the amplifier module 82 in that the frame 2 of his ergometer is accordingly displaced forward more strongly by the actuating drive 9, in order to be approximately at the center position in the case of a tie, and to lastly be displaced significantly forward once again when passing the other user. Accelerations generated by the user by means of his training performance can be intensified in a corresponding manner by the amplifier module 82. As a whole, the faster user is thus given the impression of experiencing an "actual passing maneuver" in this way. The same applies vice versa when the user is passed by another user, and the passed user is then moved backward by the actuating drive 9.

That said, the actuating drive 9 always uses a limiter 98 to consider that the adjustment speed of the frame 3, which is effected by the actuating motor 94, is a safe speed, which is permissible according to machine guideline, in order to thus avoid the danger of injury to the user. The limiter 98 is expediently formed so that, together with the actuating motor 94, it forms a creep drive, the adjustment speed of which is limited to maximally 1 m/s.

To have sufficient energy for the actuating drive 9 as well as the control device 6 or processing unit 7, respectively, even network-independently, a separate energy storage 99 is provided on the frame 2 or on the pedestal 3, which energy storage is connected to the actuating drive 9, the control device 6, or the processing unit 7, respectively, via (non-illustrated) supply lines. The energy storage 99 is embodied as an accumulator and stores electrical energy, which is required for the displacement of the frame 2 according to the invention.

Figure 7:
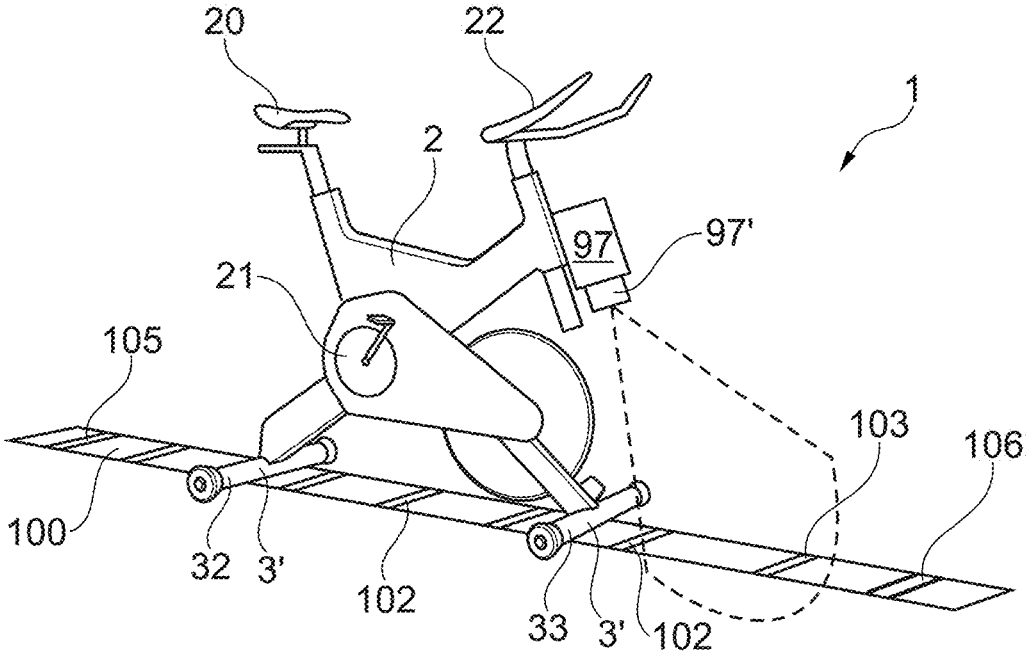
FIG. 7 shows an ergometer according to a second embodiment with a separate track marking.
Figure 8:
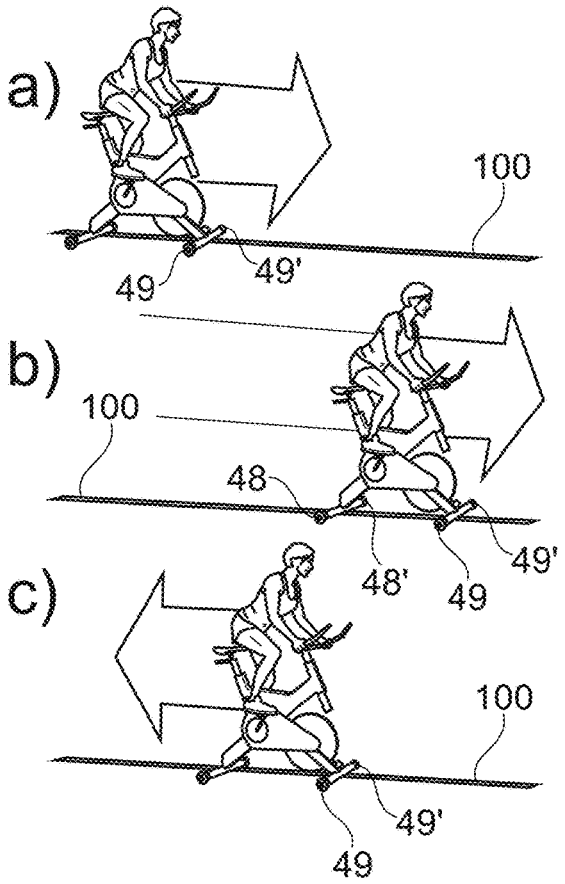
FIG. 8*a-c* show illustrations relating to the second embodiment with an actuating drive acting on roller feet in position gain and position loss phases.
Figure 9:
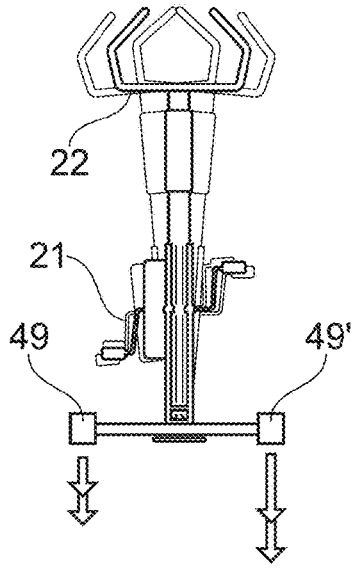
FIG. 9 shows a frontal view of the second embodiment with illustration of a lateral oscillation.

In the case of the embodiment alternatives according to FIG. 7, the pedestal 3' is not embodied as rectangular frame, as in the case of the first embodiment illustrated in FIG. 1 but is formed by means of two cross members 32, 33. On their ends, feet 4 are arranged, by means of which the cross members 32, 33 stand on a support, in particular the floor of a fitness studio. Two of the feet 4 are thereby embodied as roller feet 42, 43, which each have rollers 49, 49' arranged on the ends of the front cross member 33. The rollers 49, 49' are driven by the actuating drive 9, as already described above. The pedestal 3 can thus be rolled. It is thus attained that the entire ergometer is displaced as a function of the signal 80 for the progress indicator calculated by means of the processing unit 7. This results in a larger adjustment distance, so that a more vivid experience is provided to the user when generating a training performance according to the training reference. It goes without saying that, as already described above, the training reference can, on the one hand, be an absolute value based on a set training unit or a relative value, which is based on other users on further ergometers 1'.

A networking unit 5 is provided for communication with the further users on other ergometers 1'. It is formed to establish a connection to a data network (in particular the Internet) 50, in order to be able to communicate with the further users and their ergometers 1' in this way. The further users can thereby be anywhere, whether in the same or another room of the fitness studio or at home or at a completely different point in the world. The training data is exchanged with these further users, so that competitive competitions can take place virtually.

A non-driven roller 48, which is expediently arranged on the other cross member 32, can act as device for position detection. As already described above in connection with an encoder 96, signals for the actually covered displacement distance can be acquired in this way and can be guided back to the actuating drive 9.

Alternatively, however, it can also be provided that the actuating drive 9 is provided with a tracking device 97. As illustrated in FIG. 7, said tracking device is formed to follow a floor track marking 100 on the floor, which is preferably embodied as a linear element and extends transversely through the room, in which the ergometer is arranged. In the case of several ergometers in a room, such as typically in fitness studios, several floor track markings 100 can be arranged next to one another without intersecting, in particular in parallel. The tracking device 97 is provided with an image sensor 97' for detecting the floor track marking 100. If the image sensor 97' detects a deviation to the left (or to the right), a corresponding signal is transmitted to the tracking device 97. Said tracking device is formed to detect a directional error on the basis of the deviation and to determine a correction direction and to optionally display it on the display device 24. It expediently further cooperates with the traction control 93 in such a way that it acts as correction device. The driven roller 49' is thereby driven by the actuating motor 5 at reduced speed, opposite to the side towards which a deviation has occurred (thus the right roller a deviation to the left), in order to thus guide the deviation of the ergometer 1 back to the floor track marking 100 again.

The floor track marking 100 is preferably embodied to be adhesive, for example as a unilaterally acting adhesive tape. Distance markings 102 are expediently printed onto the top side thereof, which can additionally also be provided with intermediate markings 103. A marking for the starting point 105 as well as a target marking 106 is further expediently provided on the top side of the floor track marking 100. Expediently, the floor track marking 100 is shorter, so that a shortened version thereof can also be used in the home environment with the smaller room dimensions, which typically arise there. The edges 101 of the floor track marking 100 act as longitudinal guide for the tracking device 97.

Moreover, an actuation of the driven roller 49, 49' takes place by means of the actuating drive 9 in a corresponding manner as described above with regard to the displacement of the frame 3 relative to the pedestal 2 of the first embodiment.

If the user performs an overachievement based on the training reference (absolute or relative based on optionally virtual competitors on other ergometers 1'), the frame 3 is moved forward along the floor track marking 100 by the actuating drive 9 by means of the driven rollers 49, 49' (see FIG. 8*a*). In the case of lasting overachievement or in the case of an overachievement with particularly high speed or acceleration, and/or by means of a position gain compared to another user as competitor on another ergometer 1', the ergometer 1 is displaced forward more strongly with its frame 3 by means of the amplifier module 82, in order to thus make the position gain directly tangible for the user (see FIG. 8*b*). On the other hand, the position drive 9 will reverse accordingly and the ergometer 1 will be displaced backward with its frame 2 by means of the driven rollers 49, 49' when the performance of the user decreases compared to the reference or when a virtual competitor, in turn, passes the user, in order to thus situationally clarify his underperformance to the user and the loss of position, which optionally took place thereby (see FIG. 8*c*).

A special feature in the case of the second embodiment with driven rollers 49, 49' lies in that different vertical loads can result on the feet arranged on the left side, based on the feet arranged on the right side, under the effect of the oscillating pedaling force of the user on the pedals arranged on both sides of the ergometer 1. An example for this is visualized in FIG. 9, where, due to the driving force of the user acting on the pedal, the vertical load compared to the static normal case (black arrow) is increased on the right side (see the light-shaded arrow). The dynamic vertical load resulting from the pedaling force is therefore decreased (see shaded arrow) on the left side compared to the static normal case (black arrow). The different vertical loads on the left and on the right lead to a different contact pressure of the rollers 49, 49'. As a result, different slip can also occur on the left and right side in the case of the same driving force by the actuating motor 94, whereby the ergometer is deflected to the side with the lower vertical load (this is the left side in FIG. 9). The traction module 82 is expediently formed to detect such an imbalance resulting from the effect of the drive force of the user on the pedal drive and slip difference effected therewith, and to balance them by controlling the traction control.

Figure 10:
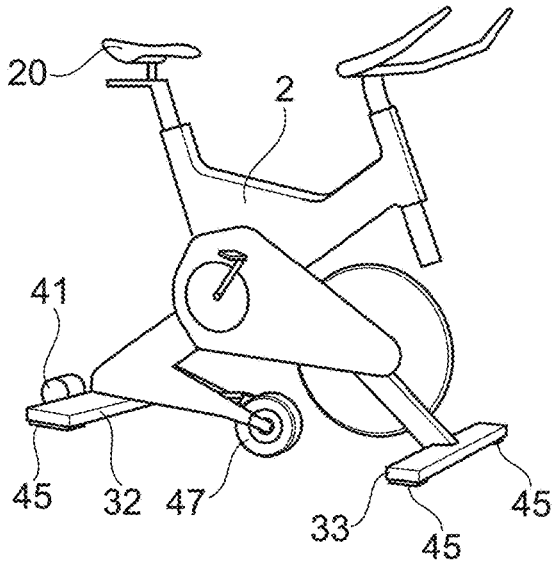
FIG. 10 shows an alternative for the second embodiment.
Figure 11:
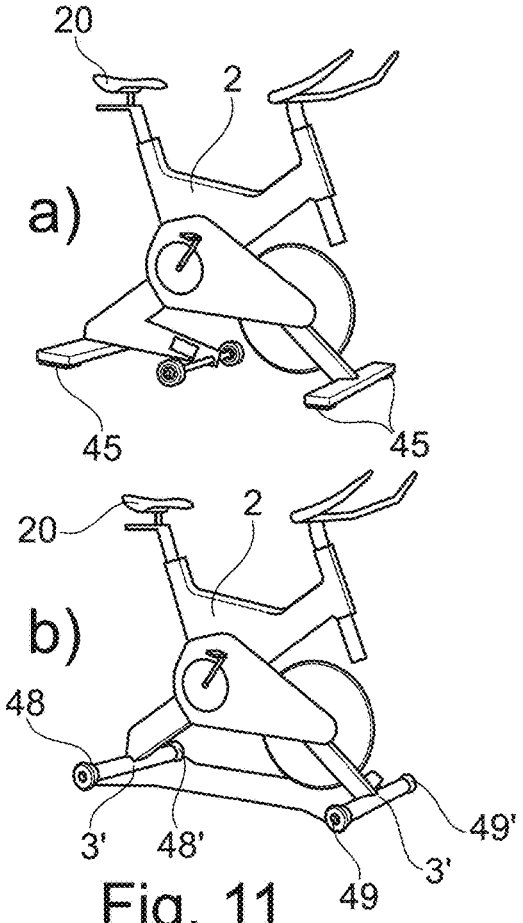
FIG. 11*a, b* show further alternatives for the second embodiment.

Alternatives for the second embodiment with driven rolling foot are illustrated in FIG. 10 and FIG. 11*a, b*. In the case of the embodiment alternative according to FIG. 10, a driven central roller 47 is thus provided, which is arranged on a beam between the cross members 32, 33. The cross members 32, 33 themselves are provided with sliders 45 on their underside, which are dimensioned so that the central driven roller 47 absorbs a majority of the vertical load at least of the rear cross member 32. This central driven roller 47 can optionally be embodied to be steerable, in order to thus compensate for a directional deviation, for example from the track marking 100, by pivoting the driven central roller 47.

Transport rollers 41 can optionally be provided on the rear side on the cross member 32 on both sides. They are arranged so that in the case of the position of the ergometer 1 illustrated in FIG. 10, they do not rest on the floor, but are arranged slightly higher. If the ergometer 1 is tilted backward via the rear cross member 32, for example for putting it away, the transport rollers 41 come into contact with the floor and the ergometer 1 can be rolled away easily.

In the case of the embodiment alternative according to FIG. 11*a*, a second set of driven rollers 49, 49', instead of the centrally driven roller 47, is arranged on an axle beam, which is likewise fastened to the beam. The function largely corresponds to the function according to FIG. 9, wherein a compensation of directional deviations can additionally take place (as described above) by systematically driving the driven roller 49, 49' on the one side. The same applies for the embodiment alternative according to FIG. 11*b*, where the driven rollers 49, 49' are provided on a front cross member and non-driven rollers 48, 48' on a rear cross member.

Figure 12:
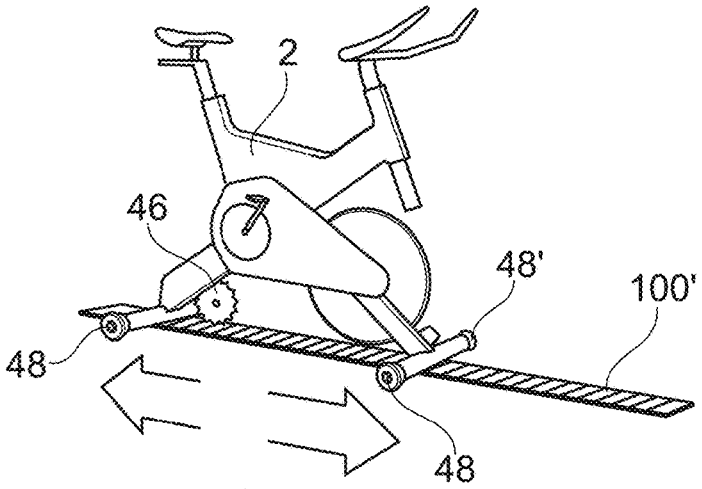
FIG. 12 shows an alternatively for FIG. 7 with a form-fit track marking.

An alternative for FIG. 7 is illustrated in FIG. 12. It differs from the second embodiment illustrated in FIG. 7 in that a track marking 100', which acts in a form-fit manner, is provided. On its top side, it is provided with a toothing in the manner of a toothed rack. The teeth preferably have a rectangular profile, in order to thus create a well-accessible surface even in the region of the toothing. The rollers 48, 48' on the cross members are not driven thereby. Instead, the actuating motor 94 of the actuating drive 9 acts on a serrated wheel 46. On its outer circumference, it has a toothing, which is designed to be complementary to the toothing of the track marking 100'. The serrated wheel 46 is mounted in the lower region of the frame 2, namely in such a way that it engages in a form-fit manner with the toothing of the track marking 100' by means of its toothing on the outer circumference. A form-fit drive is formed in this way, which effects a reliable and positionally accurate displacement of the frame 2 even in the case of contamination with fluids (sweat). This is particularly suitable for the use in fitness studios or other sports training centers, in which the users generate a maximum of physical performance.

Figure 13:
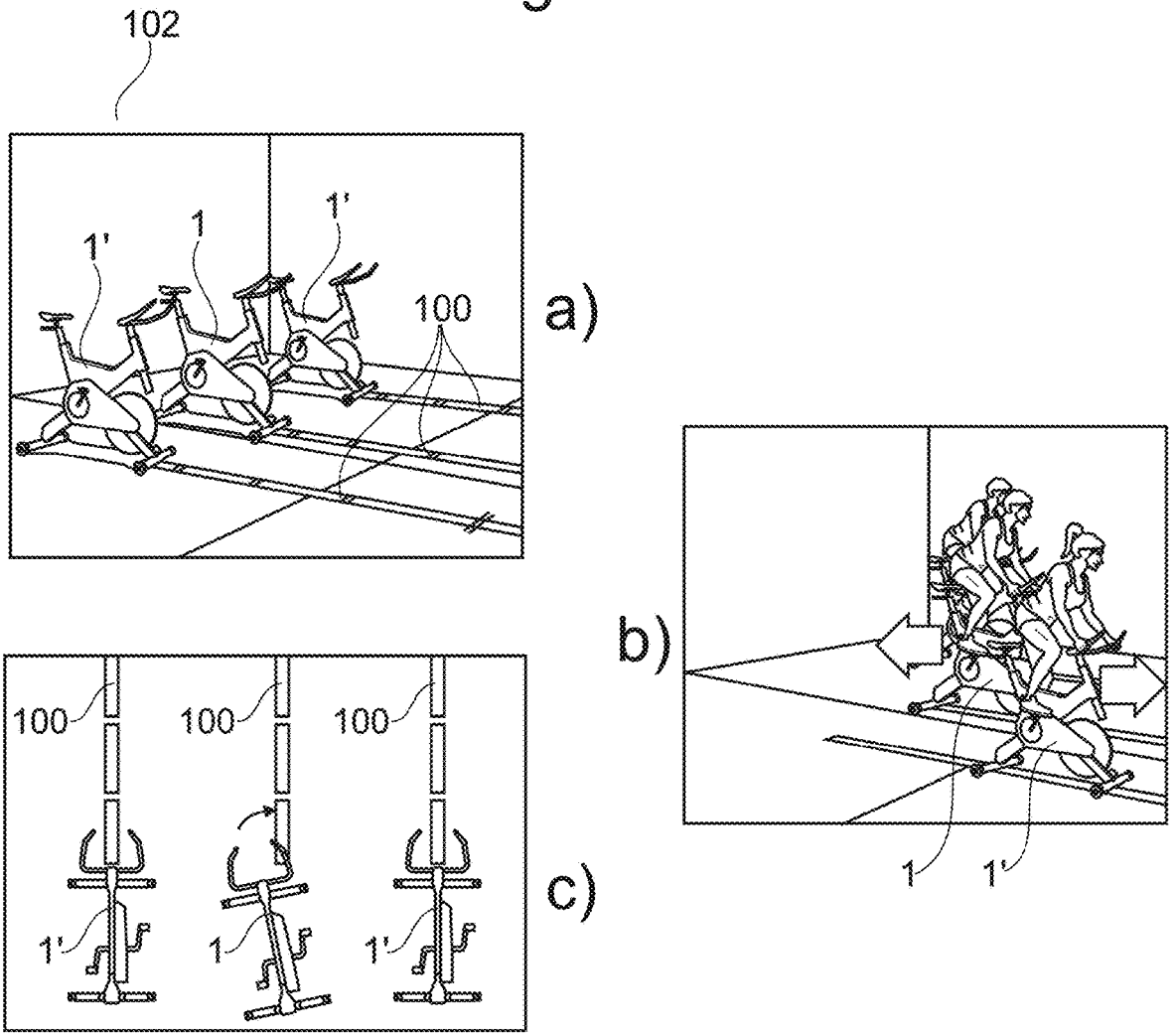
FIG. 13*a-c* show illustrations for a plurality of ergometers in a fitness studio.

A use of this type in fitness studios is visualized in FIG. 13 with different views. FIG. 13*a* shows several bike ergometers 1, 1' according to the invention, which are set up next to one another in a fitness studio with their floor track markings 100 parallel to one another. At the start, they stand next to one another, and they are displaced by the actuating drive 9 as a function of the training performance of the respective user during the training.

The relative positioning is thereby also shown. If two users compete with one another for a position (for example the lead position), it can be highlighted thanks to the amplifier module 82 for clarification purposes, which user is in front right now, even if the lead is only a few centimeters. The competition for the positions can thus be made to be clearly tangible, namely even if the simulated competition distance of 10 or 100 km is shortened to a typically 5 to 15 m short displacement along the floor track marking 100. The invention thereby also utilizes that the position loss of a user compared to another user then optionally also results in a reversing of the actuating drive 9, i.e. the user who fell behind in the position order then does not only move relative to the other users, but also absolutely backward. This is illustrated, for example, in FIG. 13*b*, where the user of the ergometer 1 falls behind and is passed by the user of the other ergometer 1'. This change in the relative positioning is converted by the respective actuating drive 9 into a forward movement of the ergometer 1' and a backward movement of the ergometer 1. This takes place independently of whether the ergometers 1, 1' are located in one place (in the indoor cycling room of a fitness studio) or at a distance from one another (and only connected via the Internet 50). A significantly more intensive competitive atmosphere can be created therewith and the experience value for the users can be increased, which results in an encouragement for further training performances.

An example for an alignment of the bike ergometers 1, 1' on the floor track markings 100 is illustrated in FIG. 13*c*. This is in particular significant when several bike ergometers 1, 1' are to be operated next to one another, in order to thus ensure a parallel operation and to avoid collisions with the adjacent apparatus. For this purpose, the tracking module expediently cooperates with an alignment module, which displays deviations detected by the tracking device 97 on the display device 24, in order to thus support a quick and correct alignment.

Figure 14A:
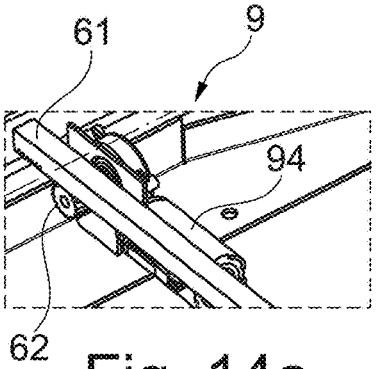
FIG. 14*a-e* show perspective views of different actuating drives.
Figure 14B:
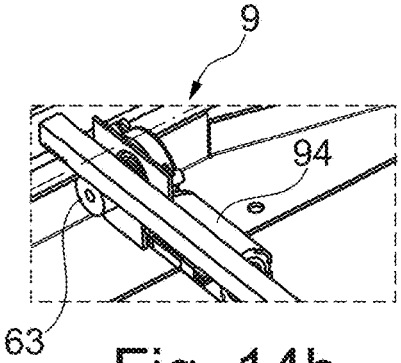
Figure 14C:
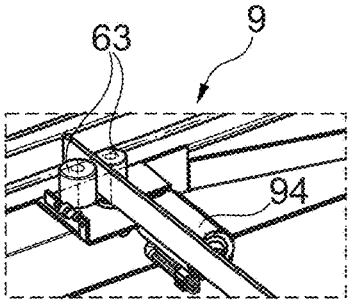
Figure 14D:
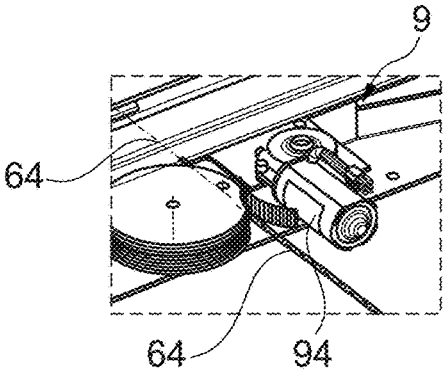
Figure 14E:
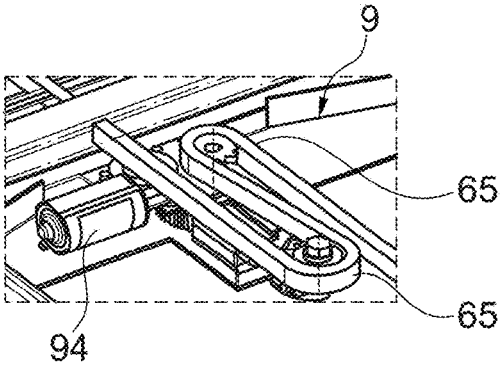

FIGS. 14*a-e* show perspective views of different actuating drives 9. These are, e.g., an actuating drive 9 with a toothed rack 61 and a toothed roller 62 (FIG. 14*a*), an actuating drive 9 with one or several friction rollers 63 (FIGS. 14*b* and 14*c*), an actuating drive 9 with a cable 64 (FIG. 14*d*), and an actuating drive 9 with a chain 65 (FIG. 14*e*). Such actuating drives 9 can be accommodated easily below the casing of the frame (2, 2*a*, 2*b*) of a training apparatus 1, so that they do not become very dirty and are thus also low-maintenance. Such actuating drives 9 are furthermore cost-efficient and reliable.

Figure 15A:
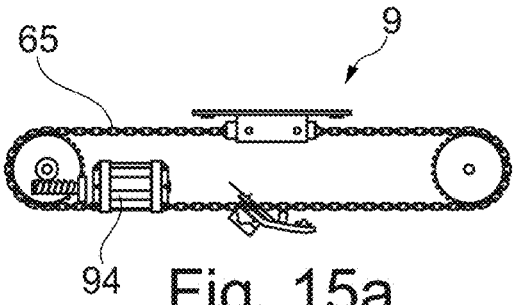
FIG. 15*a-c* show illustrations of further actuating drives.
Figure 15B:
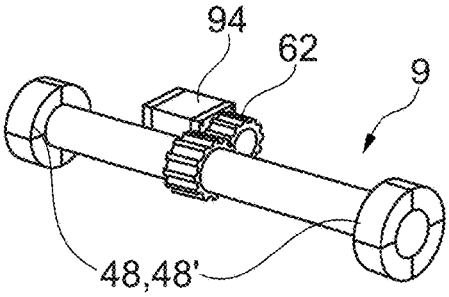
Figure 15C:
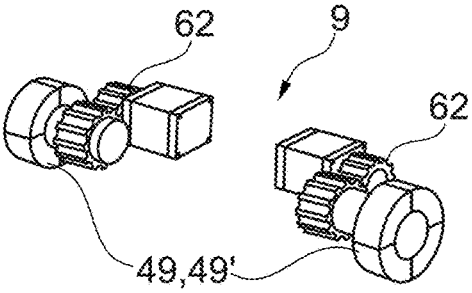

FIGS. 15*a-c* show schematic illustrations of further possible actuating drives 9, e.g. of an alternative chain drive (FIG. 15*a*), an axle drive with two rollers 48, 48' (FIG. 15*b*) as well as a drive for individual rollers 49, 49' (FIG. 15*c*). These actuating drives 9 are also cost-efficient, reliable, and low-maintenance.

Figure 16A:
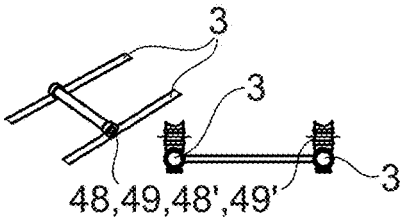
FIG. 16*a-c* show schematic illustrations for a possible positioning of rollers of a frame and of a pedestal consisting of round tubes.
Figure 16B:
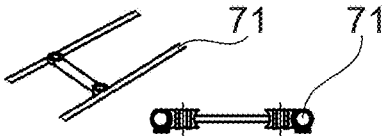
Figure 16C:
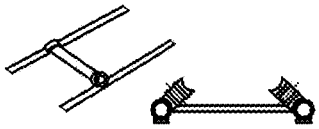
Figure 17A:
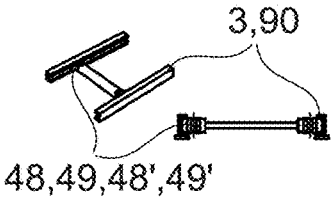
FIG. 17*a-c* show schematic illustrations for a possible positioning of rollers of a frame and of a pedestal consisting of C-profiles.
Figure 17B:
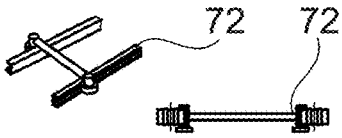
Figure 17C:
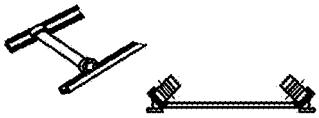
Figure 18A:
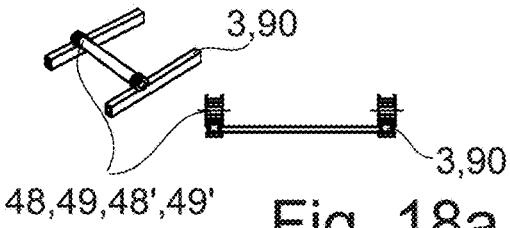
FIG. 18*a, b* show schematic illustrations for a possible positioning of rollers of a frame and of a pedestal consisting of rectangular profiles.
Figure 18B:
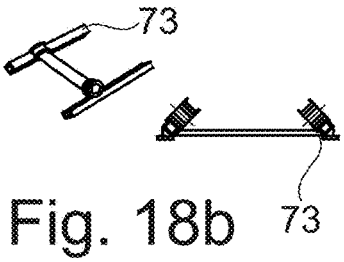
Figure 19A:
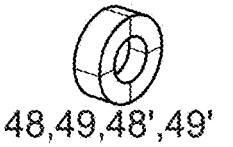
FIG. 19*a-e* show illustrations of different types of rollers.
Figure 19B:
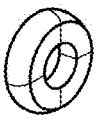
Figure 19C:
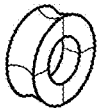
Figure 19D:
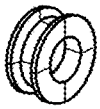
Figure 19E:
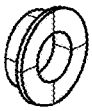
Figure 20A:
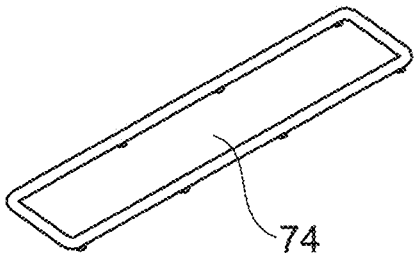
FIG. 20*a-d* show illustrations of different embodiments of the pedestal of a fitness apparatus.
Figure 20B:
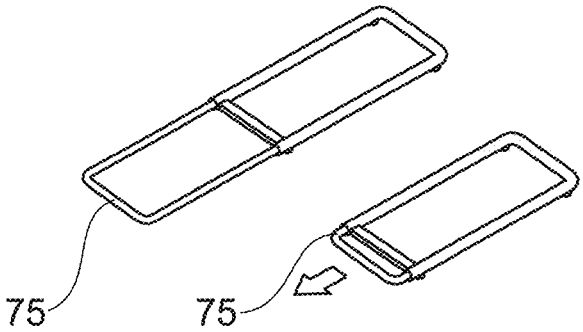
Figure 20C:
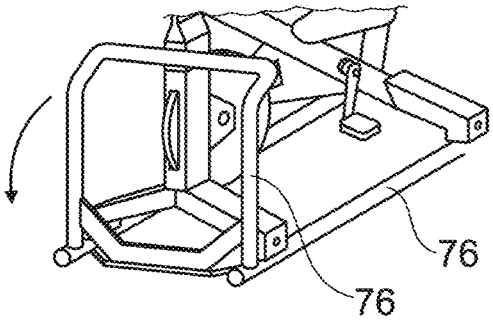
Figure 20D:
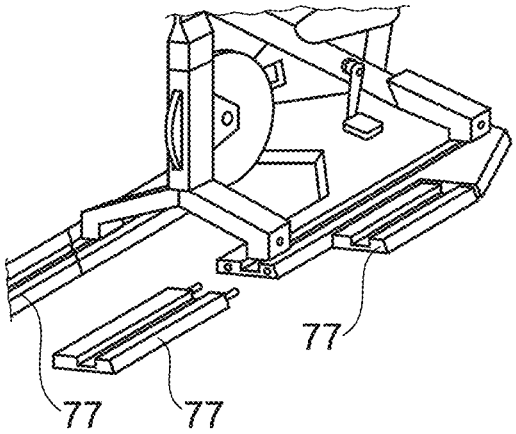

A possible positioning of rollers 48, 49, 48', 49' of a frame 2 and of a pedestal 3 consisting of round tubes 71 is shown in FIGS. 16*a* to 16*c*. FIGS. 17*a* to 17*c* are schematic illustrations for a possible positioning of rollers 48, 49, 48', 49' of a frame 2 and of a pedestal 3 consisting of C-profiles 72 or guide rails 90, respectively. Lastly, FIGS. 18*a* and 18*b* show a possible positioning of rollers 48, 49, 48', 49' of a frame 2 and of a pedestal 3 consisting of rectangular profiles 73. The rollers 48, 49, 48', 49' of the frame 2 can be positioned vertically, horizontally, or obliquely thereby on or accordingly in the tubes 71 or profiles 72, 73, respectively. All of these embodiments have in common that the user can exchange fitness apparatuses of different apparatus types easily, e.g. by pushing the fitness apparatus 1 into the pedestal 3 or by assembling the fitness apparatus 1 on the pedestal 3.

FIGS. 19*a* to 19*e* thereby show different types of rollers 48, 49, 48', 49', e.g. rectangular (FIG. 19*a*), convex (FIG. 19*b*), concave (FIG. 19*c*) rollers or also so-called H-rollers (FIG. 19*d*) and so-called L-rollers (19). Each type of rollers 48, 49, 48', 49' is particularly well suited for a certain construction of the pedestal 3, for instance concave rollers for pedestals 3 of round tubes 71 or H- and L-rollers for pedestals 3 of rectangular profiles 73.

FIGS. 20*a-d* show different embodiments of the pedestal 3 of a fitness apparatus 1, for example a large pedestal 74, a telescopic pedestal 75, wherein the telescopic capability is not only possible in the pedestal length but also in the pedestal width, a foldable pedestal 76 as well as a plug-in part pedestal 77 formed from assembled parts.

The pedestals 3 can thus be adapted to the particular features of respective apparatus types 1*a*, 1*a'*, 1*b*, 1*c*, 1*d*, 1*e* by the user, e.g. lengthened for a rowing apparatus 1*b* or widened for a treadmill 1*e*.

LIST OF REFERENCE NUMERALS

- fitness apparatus (1) of a different apparatus type, e.g. ergometer (1*a*), speed bike (1*a'*), rowing apparatus (1*b*), elliptical trainer (1*c*), cross trainer (1*d*), or treadmill (1*e*)
- frame (2), e.g. two-piece frame (2*a*, 2*b*)
- pedestal (3, 3'), e.g. telescopic pedestal (3*a*, 3*b*)
- networking unit (5)
- control device (6)
- processing unit (7)
- signal unit (8)
- actuating drive (9)
- seat (20) or seat saddle (20), respectively
- force transmission device (21), e.g. pedal unit (21*a*) of an ergometer (1*a*), pull rope (21*b*) of a rowing apparatus (1*b*), running arms of an elliptical trainer (1*c*) or cross trainer (1*d*), including movable arms (21*c*, 21*d*) and pedal arms (21*c'*, 21*d'*), running belt (21*e*) of a treadmill (1*e*)
- hand grip (22)
- input device (23)
- display device (24)

user interface (25)
sensor (26)
drive device (27), e.g. braking device (27)
cross member (32, 33)
transport rollers (41)
slider (45)
serrated wheel (46)
rollers (47, 48, 49, 48', 49')
central roller (47)
Internet (50)
toothed rack (61)
toothed roller (62)
friction roller (63)
cable (64)
chain (65)
round tube (71)
C-profile (72)
rectangular profile (73)
large pedestal (74)
telescopic pedestal (75)
foldable pedestal (76)
plug-in part pedestal (77)
signal (80)
traction module (82) or amplifier module (82), respectively
guide rails (90)
spindle (90')
end position detection (92, 92')
traction control device (93)
actuating motor (94)
sliding block (95)
internal thread (95')
device for position detection (96, 97)
tracking device (97)
energy source (99)
track marking (100, 100') or marking tape, respectively
track markings with distance markings (102, 103)

The invention claimed is:

1. A fitness apparatus (1) comprising:

a drive device (27) for receiving a training performance generated by a user;

a force transmission device (21) for transmitting the performance generated by the user during the training to the drive device (27);

a frame (2, 2*a*, 2*b*), on which the drive device (27) and a force transmission device (21) are arranged, wherein the frame (2, 2*a*, 2*b*) is further designed to support the user of the fitness apparatus (1) while performing fitness exercises;

a pedestal (3, 3') supporting the frame (2, 2*a*, 2*b*) for resting on a subsurface;

at least one sensor (26) for determining the training performance generated by the user;

a control device (6), which is formed to receive data from the at least one sensor (26), wherein the control device (6) cooperates with:

a processing unit (7), which is formed to determine a measure of success from the training performance generated by the user, and a signal unit (8), which is formed to generate a signal (80) for a progress indicator, based on the determined measure of success, characterized in that the frame (2, 2*a*, 2*b*) or the pedestal (3') of the fitness apparatus (1) has rollers (47, 48, 49, 48', 49'), which are arranged on the frame (2, 2*a*, 2*b*) or on the pedestal (3') in such a way that a tilt-stable positioning of the frame (2) with respect to the subsurface as well as a longitudinal displacement of the frame (2) or of the frame (2) together with the pedestal (3') relative to the subsurface is made possible, and wherein the fitness apparatus (1) further has at least one actuating drive (9), which is formed to displace the frame (2) relative to the pedestal (3) or the frame (2) together with the pedestal (3') relative to the subsurface in the longitudinal direction as a function of the signal (80) by means of the rollers (47, 48, 49, 48', 49') in a motorized manner.

2. The fitness apparatus (1) according to claim 1, wherein the fitness apparatus (1) is formed as an apparatus of one of the below-mentioned different apparatus types, namely as an ergometer (1*a*), a speed bike (1*a'*), a recumbent bike, a home training bike, a rowing apparatus (1*b*), an elliptical trainer (1*c*), a cross trainer (1*d*), or a treadmill (1*e*).

3. The fitness apparatus (1) according to claim 2, wherein the fitness apparatus (1) of each of the different apparatus types (1*a*, 1*a'*, 1*b*, 1*c*, 1*d*, 1*e*) is based on a base, which is unified in terms of technical design, for fitness apparatuses of different apparatus types (1*a*, 1*b*, 1*c*, 1*d*, 1*e*).

4. The fitness apparatus (1) according to claim 1, wherein at least one roller (47, 48, 49, 48', 49') is driven by an actuator (94) of the actuating drive (9), so that a longitudinal displacement of the frame (2, 2*a*, 2*b*) or of the frame (2) together with the pedestal (3') relative to the subsurface can be created.

5. The fitness apparatus (1) according to claim 1, wherein the at least one sensor (26) for determining the training performance generated by the user is arranged on the drive device (27) and/or on the force transmission device (21, 21*a*, 21*b*, 21*c*, 21*d*, 21*e*).

6. The fitness apparatus (1) according to claim 1, wherein the roller (47, 48, 49, 48', 49') is embodied as a friction roller, a serrated roller, a toothed roller, a sliding roller and/or a running roller.

7. The fitness apparatus (1) according to claim 1, wherein the fitness apparatus (1) is embodied as ergometer (1*a*), speed bike (1*a'*), recumbent bike or a home training bike.

8. A fitness apparatus (1), namely ergometer (1*a*), speed bike (1*a'*), recumbent bike or home training bike, according to claim 7, wherein the pedestal (3) is formed by two cross members (32, 33), on the ends of which a roller (48, 49, 48', 49') is arranged in each case, wherein the rollers (48, 49, 48', 49') rest on the subsurface, and wherein at least two rollers (49, 49') are driven by the actuator (94).

9. The fitness apparatus (1), namely ergometer (1*a*), speed bike (1*a'*), recumbent bike or home training bike, according to claim 7, wherein:

the pedestal (3) is formed by two cross members (32, 33), on the ends of which sliders (45) and/or rollers (48, 49, 48', 49') are arranged in each case, which rest on the subsurface, and the at least one roller (47, 49) driven by the actuator (94) is arranged either as steerable central roller (47) or as set of driven rollers (49, 49') on a beam.

10. The fitness apparatus (1), namely ergometer (1*a*), speed bike (1*a'*), recumbent bike or home training bike, according to claim 7, wherein:

the rollers (48, 49, 48', 49') are arranged on the frame (2, 2*b*) and run in or on guide rails (90) of the pedestal (3, 3*a*, 3*b*); and the at least one driven roller (49) is formed to displace the frame (2, 2*a*, 2*b*) relative to the stationary pedestal (3) and thus also relative to the subsurface.

11. The fitness apparatus (1) according to claim 1, wherein the processing unit (7) is formed to control the actuating drive (9) in a reversible manner.

12. The fitness apparatus (1) according to claim 1, wherein the signal unit (8) cooperates with an amplifier module (82), which is formed to consider an acceleration generated by the training performance for the progress indicator.

13. The fitness apparatus (1) according to claim 1, wherein:

the actuating drive (9) is provided with an end position detection (92, 92'), which is formed to turn off and/or to reverse the actuating drive (9) when reaching an end position; and/or the actuating drive (9) is embodied in a form-fit manner.

14. The fitness apparatus (1) according to claim 1, wherein the actuating drive (9) is a creep drive, which drives the at least one roller (49, 49') at a speed, which is lower than walking speed and maximally 1 m/s.

15. The fitness apparatus (1) according to claim 1, wherein the actuating drive (9) has a traction control (93) for the at least one driven roller (49, 49'), wherein a detected slip of the at least one driven roller (49, 49') is guided back to the processing unit (7).

16. The fitness apparatus (1) according to claim 1, wherein the actuating drive (9) has a device for position detection (96, 97), which is formed to output a signal to the processing unit (7).

17. The fitness apparatus (1) according to claim 16, wherein the device for position detection has a sensor (97'), which is formed to detect floor track markings (100), wherein the floor track markings (100) are formed as track markings with distance markings (102, 103).

18. The fitness apparatus (1) according to claim 17, wherein the floor track markings (100) are formed as marking tape, which is arranged on the subsurface.

19. The fitness apparatus (1) according to claim 17, further comprising an alignment module, which is formed to detect and display directional deviations by means of the floor track markings (100).

20. The fitness apparatus (1) according to claim 19, wherein the alignment module is formed to display a correction direction.

21. The fitness apparatus (1) according to claim 1, wherein the rollers (47, 48, 49, 48', 49') are arranged on the frame (2) or on the pedestal (3') in such a way that a crushing danger-minimizing longitudinal displacement of the frame (2) or of the frame (2) together with the pedestal (3') relative to the subsurface is made possible.

* * * * *